US011607100B2

(12) United States Patent
DeJonge

(10) Patent No.: US 11,607,100 B2
(45) Date of Patent: Mar. 21, 2023

(54) EXTRACTION CLEANER

(71) Applicant: BISSELL Inc., Grand Rapids, MI (US)

(72) Inventor: Mitchell DeJonge, Fruitport, MI (US)

(73) Assignee: BISSELL Inc., Grand Rapids, MI (US)

( * ) Notice: Subject to any disclaimer, the term of this patent is extended or adjusted under 35 U.S.C. 154(b) by 579 days.

(21) Appl. No.: 16/528,895

(22) Filed: Aug. 1, 2019

(65) Prior Publication Data

US 2019/0350427 A1 Nov. 21, 2019

Related U.S. Application Data

(63) Continuation of application No. 15/241,170, filed on Aug. 19, 2016, now Pat. No. 10,368,713, which is a continuation of application No. 13/898,619, filed on May 21, 2013, now Pat. No. 9,427,128.

(60) Provisional application No. 61/652,578, filed on May 29, 2012.

(51) Int. Cl.

| | |
|---|---|
| ***A47L 11/40*** | (2006.01) |
| ***A47L 7/00*** | (2006.01) |
| ***A47L 11/34*** | (2006.01) |
| *A47L 11/30* | (2006.01) |

(52) U.S. Cl.

CPC ..... *A47L 11/4044* (2013.01); *A47L 7/0004* (2013.01); *A47L 7/0009* (2013.01); *A47L 11/4016* (2013.01); *A47L 7/0014* (2013.01); *A47L 11/302* (2013.01); *A47L 11/34* (2013.01); *A47L 11/408* (2013.01); *A47L 11/4041* (2013.01); *A47L 11/4083* (2013.01); *A47L 11/4088* (2013.01)

(58) Field of Classification Search

CPC .... A47L 11/4084; A47L 11/34; A47L 7/0014; A47L 11/408; A47L 11/4044; A47L 7/0009; A47L 11/4083; A47L 11/4088; A47L 7/0004; F16B 21/02

See application file for complete search history.

(56) References Cited

U.S. PATENT DOCUMENTS

| | | | |
|---|---|---|---|
| 1,222,436 | A | 4/1917 | Mason |
| 1,258,822 | A | 3/1918 | Smith |
| 1,365,123 | A | 1/1921 | Bouwmeester |
| 2,064,587 | A | 12/1936 | Carlstedt |
| 3,039,130 | A | 6/1962 | Belicka et al. |
| 3,790,987 | A | 2/1974 | MacFarland |
| 4,610,047 | A | 9/1986 | Dick et al. |

(Continued)

FOREIGN PATENT DOCUMENTS

EP 1018314 A1 7/2000

OTHER PUBLICATIONS

Partswarehouse.com DysonDC07 parts, Parts No. 17-17d and 31-31b; https://www.partswarehouse.com/Dyson-DC07-Upright-s/3893.htm?gclid=EAlalQobChMlooz7s9yx9QIVpNSzCh2NWQTxEAAYASAAEgiUK_D_BwE (Year: 2008).*

(Continued)

*Primary Examiner* — Bryan R Muller
(74) *Attorney, Agent, or Firm* — Quinn IP Law

(57) ABSTRACT

An extraction cleaner for a floor surface includes an extraction nozzle. The extraction nozzle that defines a fluid flow path having an elongated nozzle opening, and includes one or more stiffening elements that stiffens the walls around the nozzle opening to prevent collapsing or deformation of the extraction nozzle during use.

19 Claims, 15 Drawing Sheets

(56) References Cited

U.S. PATENT DOCUMENTS 4,953,254 A * 9/1990 Kohl ..... A47L 11/4044 15/322
5,455,982 A 10/1995 Armstrong et al.
6,131,237 A * 10/2000 Kasper ..... A47L 5/30 15/320
6,145,159 A 11/2000 Zahuranec et al.
6,533,871 B2 3/2003 Zahuranec et al.
6,721,990 B2 4/2004 Zahuranec et al.
6,842,942 B2 * 1/2005 Morgan ..... A47L 5/28 15/322
7,039,985 B2 5/2006 Hisrich et al.
7,367,083 B2 5/2008 Barker et al.
7,617,563 B2 * 11/2009 Hertrick ..... A47L 11/4088 15/322
7,784,148 B2 8/2010 Lenkiewicz et al.
8,800,106 B2 * 8/2014 Bilek ..... A47L 11/4083 15/384
9,107,558 B2 * 8/2015 Lenkiewicz ..... A47L 11/4019
2003/0051309 A1 3/2003 Morgan et al.
2008/0196193 A1 * 8/2008 Huffman ..... A47L 11/34 15/320
2014/0245560 A1 * 9/2014 Huang ..... A47L 11/4088 15/322

OTHER PUBLICATIONS

Dyson OPS Manual, Jul. 1, 2008, p. 15 and 17; https://oldmedia.dyson.com/medialibrary/Files/Dyson/Support/downloads/US/Floorcare/manuals/DC07_OPMAN_07112011%20pdf.pdf (Year: 2008).*

Partswarehouse.com DysonDC07 parts, Parts No. 17-17d and 31-31b; https://www.partswarehouse.com/Dyson-DC07-Upright-s/3893.htm?gclid=EAIaIQobChMIooz7s9yx9QIVpNSzCh2NWQTxEAAYASAAEglUK_D_BwE (Year: 2008).*

* cited by examiner

EXTRACTION CLEANER

CROSS-REFERENCE TO RELATED APPLICATIONS

This application is a continuation of U.S. patent application Ser. No. 15/241,170, filed Aug. 19, 2016, now U.S. Pat. No. 10,368,713, which is a continuation of U.S. patent application Ser. No. 13/898,619, filed May 21, 2013, now U.S. Pat. No. 9,427,128, which claims the benefit of U.S. Provisional Patent Application No. 61/652,578, filed May 29, 2012, all of which are incorporated herein by reference in their entirety.

BACKGROUND

Extractors are well-known devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a conduit, and a source of suction in fluid communication with the conduit to draw the cleaning fluid from the surface to be cleaned and through the nozzle and the conduit to the recovery tank. Examples of extractors are disclosed in commonly assigned U.S. Pat. No. 6,131,237 to Kasper et al. and U.S. Pat. No. 7,784,148 to Lenkiwicz et al., both of which are incorporated herein by reference in their entirety.

BRIEF DESCRIPTION

An aspect of the present disclosure relates to an extraction cleaner for a floor surface, including a first housing having a base assembly with a first retainer, the base assembly configured for movement across the floor surface and a handle assembly pivotally mounted to a rearward portion of the base assembly for directing the base assembly across the floor surface, a fluid recovery system at least partially supported by the first housing, the fluid recovery system including a recovery tank for storing spent cleaning fluid and dirt that is recovered from the floor surface, a suction source configured to generate a working airflow, and an extraction nozzle extending towards a surface to be cleaned and in fluid communication with the recovery tank, a secondary housing removably mounted to the base assembly, the secondary housing including the extraction nozzle and a second retainer, and at least one lock assembly provided for selectively coupling the secondary housing to the base assembly, the at least one lock assembly having a body configured to be selectively received within the first retainer and the second retainer Another aspect of the present disclosure relates to an extraction cleaner for a floor surface, including a first housing having a base assembly with a first mounting feature, the base assembly configured for movement across the floor surface and a handle assembly pivotally mounted to a rearward portion of the base assembly for directing the base assembly across the floor surface, a fluid recovery system supported by the housing for removing the spent cleaning fluid and dirt from the floor surface and storing the spent cleaning fluid and dirt, having a recovery tank for storing spent cleaning fluid and dirt that is recovered from the floor surface, an extraction nozzle extending towards a surface to be cleaned and in fluid communication with the recovery tank, and a suction source in fluid communication with the recovery tank and configured to generate a working airflow through the extraction nozzle and into the recovery tank, and a modular unit having a secondary housing that is removably mounted to the base assembly, the secondary housing including a second mounting feature, complimentary with the first mounting feature, and the extraction nozzle wherein when the modular unit is mounted to the base assembly the first mounting feature retains the second mounting feature or is retained within the second mounting feature

BRIEF DESCRIPTION OF THE FIGURES

The present disclosure will now be described with respect to the drawings in which.

DETAILED DESCRIPTION

The present disclosure relates to a surface cleaning apparatus that delivers cleaning fluid to a surface to be cleaned and extracts spent cleaning fluid and debris from the surface.

Figure 1:
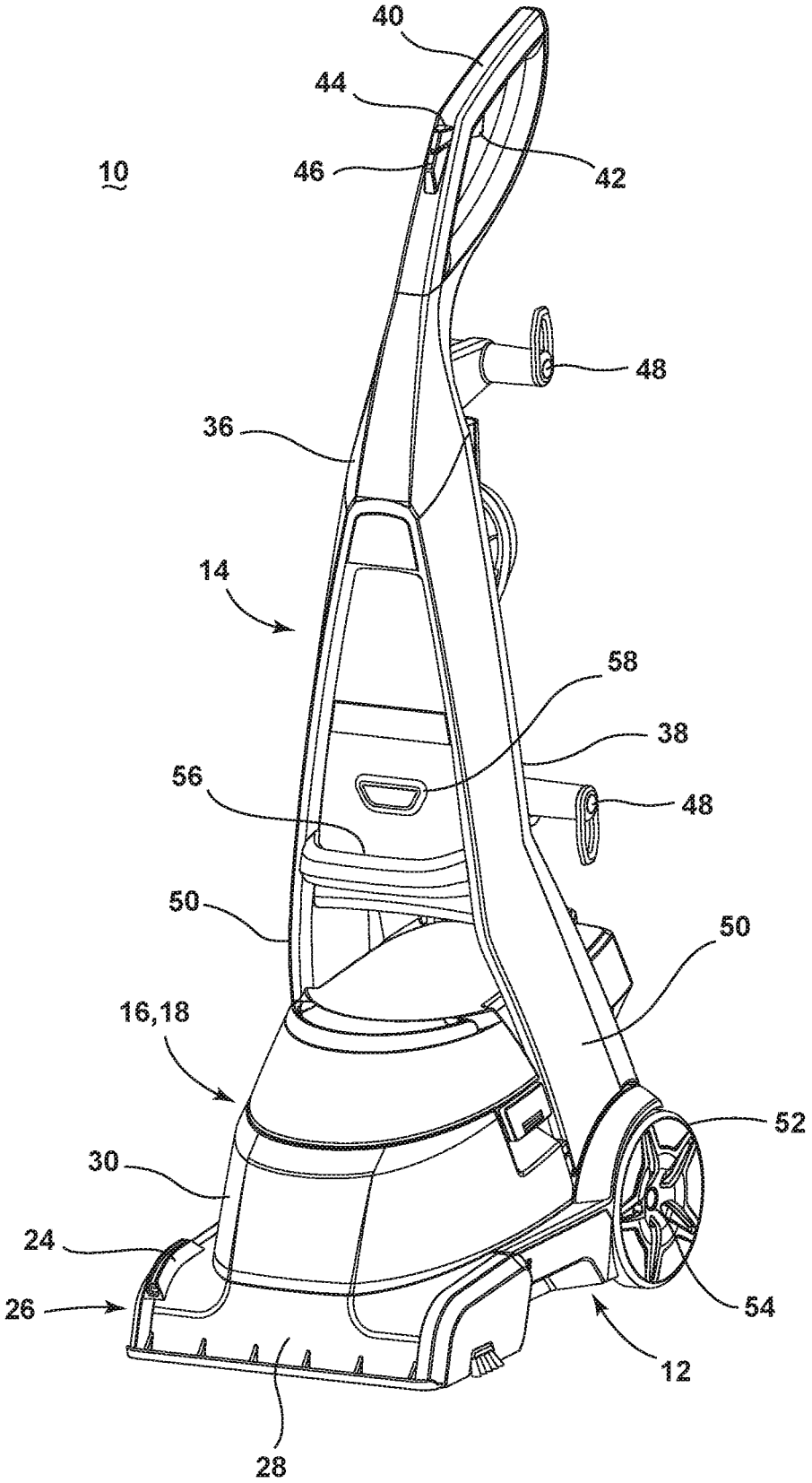
FIG. 1 is a front perspective view of an extraction cleaner according to a first example of the present disclosure, with a handle assembly pivotally mounted to a base assembly.

FIG. 1 is a front perspective view of an extraction cleaner 10 according to a first example of the present disclosure. The extraction cleaner 10 includes a housing having a base assembly 12 for movement across a surface to be cleaned and a handle assembly 14 pivotally mounted to a rearward portion of the base assembly 12 for directing the base assembly 12 across the surface to be cleaned. The extraction cleaner 10 is illustrated as an upright extractor, although aspects of the present disclosure may be applicable to other types of extraction cleaners, including canister extractors having a cleaning implement connected to a wheeled base by a suction hose, portable extractors adapted to be hand carried by a user for cleaning relatively small areas, and commercial extractors.

The extraction cleaner 10 can include a fluid delivery system 16 for storing cleaning fluid and delivering the cleaning fluid to the surface to be cleaned and a fluid recovery system 18 for removing the spent cleaning fluid and dirt from the surface to be cleaned and storing the spent cleaning fluid and dirt. The components of the fluid delivery system 16 and the fluid recovery system 18 can be supported by either or both the base assembly 12 and the handle assembly 14. In the illustrated example, the components are primarily supported by the base assembly 12.

Figure 2:
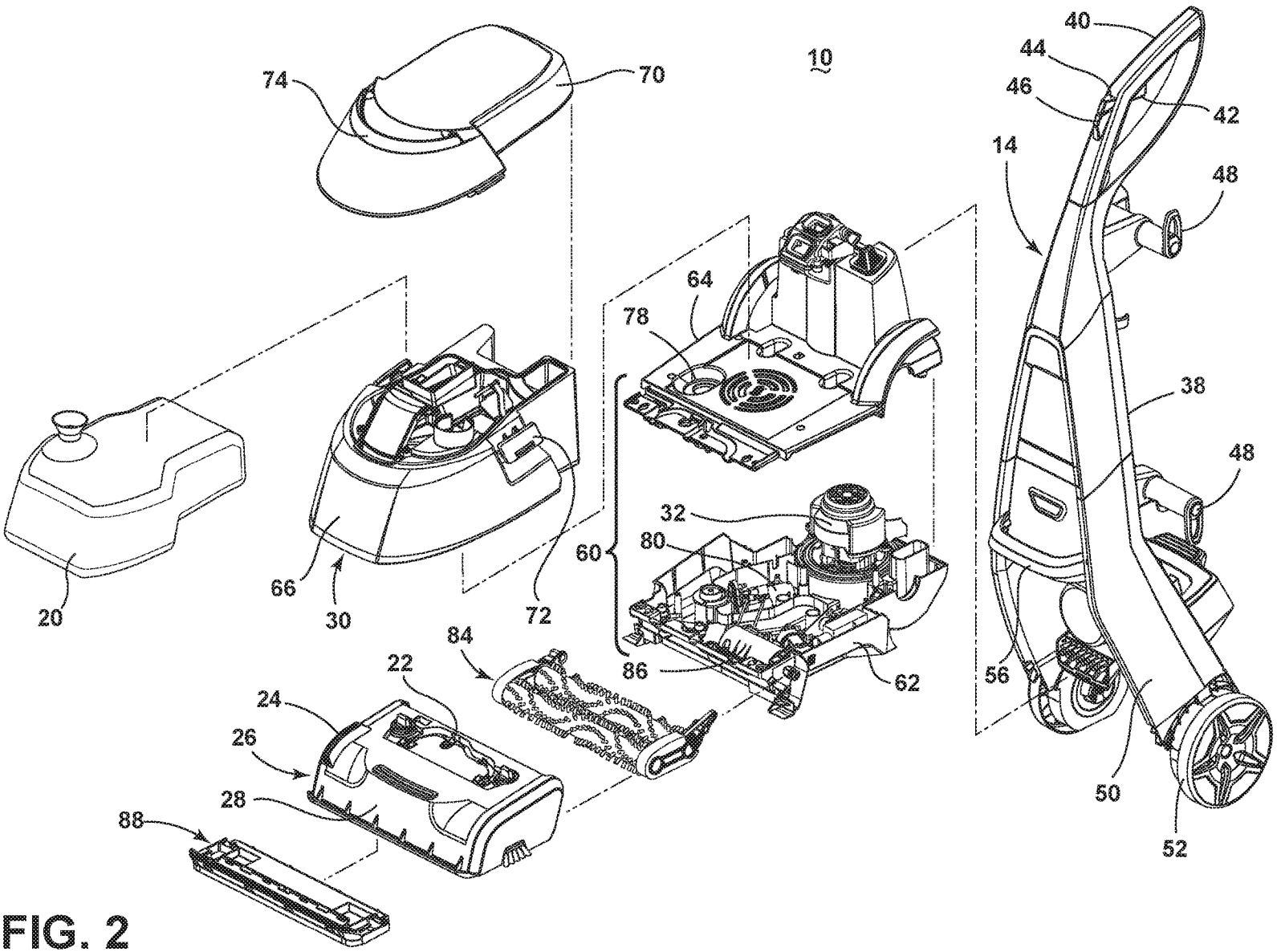
FIG. 2 is a partially-exploded view of the extraction cleaner from FIG. 1, showing a modular nozzle/spray unit.

FIG. 2 is a partially-exploded view of the extraction cleaner 10. The fluid delivery system 16 can include a fluid supply container 20 for storing a supply of cleaning fluid, a primary fluid distributor 22 in fluid communication with the supply container 20 for depositing a cleaning fluid onto the surface, and an auxiliary fluid distributor 24 in fluid communication with the supply container 20 for depositing cleaning fluid onto a smaller section of the surface to be cleaned. The fluid supply container 20, the primary fluid distributor 22, and the auxiliary fluid distributor 24 may be mounted to the base assembly 12 as illustrated. Various combinations of optional components can be incorporated into the fluid delivery system 16 such as a conventional fluid pump, a heater, or fluid control and mixing valves as is commonly known in the art.

The fluid recovery system 18 can include a modular nozzle/spray unit 26 that includes an extraction pathway in the form of an extraction nozzle 28 extending towards a surface to be cleaned, a recovery tank 30 and a working air conduit (not shown) associated with the base assembly 12 and in fluid communication with the extraction nozzle 28 and the recovery tank 30. The extraction nozzle 28 can define an extraction path of the extraction cleaner 10, with the width of the extraction nozzle 28 corresponding to the width of the extraction path. The fluid recovery system 18 can also include a suction source such as a motor/fan assembly 32 in fluid communication with the recovery tank 30 and configured to generate a working airflow to draw liquid and entrained debris through the extraction nozzle 28 and into the recovery tank 30. A separator (not shown) can be formed in a portion of the recovery tank 30 for separating liquid and entrained debris from the working airflow. A vacuum or suction hose (not shown) can also be operably coupled to the extraction cleaner 10 and can be selectively fluidly coupled to a motor/fan assembly 32 for above-the-floor cleaning.

The handle assembly 14 includes an upper handle portion 36 and a lower handle portion 38. A hand grip 40 is provided at a terminal end of the upper handle portion 36. A trigger 42 can be provided within the hand grip 40 and is operably coupled with the fluid delivery system 16 to dispense fluid from the primary fluid distributor 22. A button 44 can be provided on the front of the hand grip 40 and is operably coupled with the fluid delivery system 16 to dispense fluid from the auxiliary fluid distributor 24. The trigger 42 can be positioned at a rear side of the hand grip 40 for easy manipulation by a trigger finger of the user and the button can be retained within a pocket 46 formed on a front side of the hand grip 40 for easy manipulation by a thumb of the user. A combined hose/cord wrap caddy 48 can be provided on the rear side of the upper handle portion 36 for storing the suction hose and a power cord (not shown) which can be used to provide power to electrical components of the extraction cleaner 10 from a source of power, such as a home power supply. Alternatively, the extraction cleaner 10 can be powered by a portable power supply, such as a battery.

The lower handle portion 38 is generally U-shaped, with downwardly-extending legs 50 that define a space therebetween for accommodating the base assembly 12. The legs 50 can support wheels 52 which are rotatably mounted to outer sides of the lower ends of the legs 50 through axles 54. The wheels 52 at least partially support the base assembly 12 on the surface to be cleaned, and the axles 54 provide a pivot axis for pivotal movement of the handle assembly 14 relative to the base assembly 12.

The lower handle portion 38 also includes a carry handle 56 at a forward portion thereof which facilitates carrying the extraction cleaner 10 from one location to another, and a power switch 58, which is operably connected to the motor/fan assembly 32 and additional electrical components, such as a heater (not shown) for selectively energizing the components.

The base assembly 12 includes a base housing 60 that supports the recovery tank 30 at a forward portion thereof, forward being defined as relative to the mounting location of the handle assembly 14 on base foot assembly 12. The base housing 60 can be formed in multiple pieces, and includes at least a lower housing piece 62 and an upper housing piece 64, which define a space therebetween in which one or more components of the extractor 10 can be accommodated.

The recovery tank 30 includes a recovery tank housing 66 that defines a recovery chamber used to stored spent cleaning fluid and dirt that is recovered from the surface to be cleaned. The recovery tank housing 66 can be closed by a lid 70 which can be selectively attached to the recovery tank housing 66 by a latch assembly 72. The lid 70 can include a handle 74 for carrying the recovery tank housing 66 when it is separated from the base assembly 12.

The recovery tank 30 is sized to receive the fluid supply container 20, illustrated herein as a flexible bladder that stores a cleaning fluid. A suitable bladder is disclosed in the above-referenced Kasper '237 patent. The bladder 20 includes a valved outlet (not shown) that is secured to a valve receiver 78 for controlling flow of the cleaning fluid from the bladder 20. The cleaning fluid can include any suitable cleaning fluid, including, but not limited to, water, concentrated detergent, diluted detergent, and the like. Both the primary and auxiliary fluid distributors 22, 24 can deliver cleaning fluid from the bladder 20 onto the surface to be cleaned. Although not illustrated, other supply tanks or containers can be provided such that the primary and auxiliary fluid distributors 22, 24 deliver cleaning fluid from separate tanks or containers that contain the same or different concentrations or compositions of cleaning fluid. The solution supply container 20 can also alternatively include a tank supported separately from the recovery tank 30.

At a rearward portion, the base housing 60 accommodates the motor/fan assembly 32. The motor/fan assembly 32 is in fluid communication with the recovery tank housing 66, when the recovery tank 30 is mounted to the base assembly 12, such that air is drawn through the motor/fan assembly 32 before being exhausted from the extraction cleaner 10. The base housing 60 also accommodates a pump assembly 80, and, optionally, a heater 82. The pump assembly 80 can be considered part of the fluid delivery system and has an inlet in fluid communication with the supply container 20 and an outlet in fluid communication with the valve receiver 78. The pump assembly 80 is configured to supply fluid from the supply container 20 to the primary and auxiliary fluid distributors 22, 24. A heater (not shown) can be provided for heating fluid being transported to one or both of the distributors 22, 24, and can be any suitable heater that can heat fluids, such as an in-line heater.

An agitator assembly 84 for scrubbing the surface to be cleaned can be accommodated within the modular nozzle/spray unit 26. The base housing 60 can also have associated connections and/or fittings for coupling the agitator assembly 84 to a source of rotation, such as an agitator motor 86. The agitator motor 86 can be accommodated within the base housing 60 for driving the agitator assembly 84 via a commonly-known arrangement, such as including one or more belts and/or gears. The agitator assembly 84 can define a cleaning path of the extraction cleaner 10, with the width of the agitator assembly 84 corresponding to the width of the cleaning path.

The modular nozzle/spray unit 26 may include the extraction nozzle 28, the primary fluid distributor 22, and, as illustrated, the auxiliary fluid distributor 24. The unit 26 can also have associated conduits, connections, and/or fittings for coupling the extraction nozzle 28, the primary fluid distributor 22, the auxiliary fluid distributor 24 to the recovery tank 30 and the supply container 20, respectively. Since the modular nozzle/spray unit 26 includes components of the fluid delivery system 16 and the fluid recovery system 18, the modular nozzle/spray assembly can be considered to be part of both the fluid delivery and recovery systems 16, 18. The unit 26 can also form an agitator housing for the agitator assembly 84. Optionally, a bare floor tool 88 can be secured to the unit 26 when bare floor cleaning is desired, and can carry one or more bare floor cleaning implements, such as a squeegee, a sponge, and or a brush. The tool 88 can be snap fit to the bottom of the unit 26.

Figure 3:
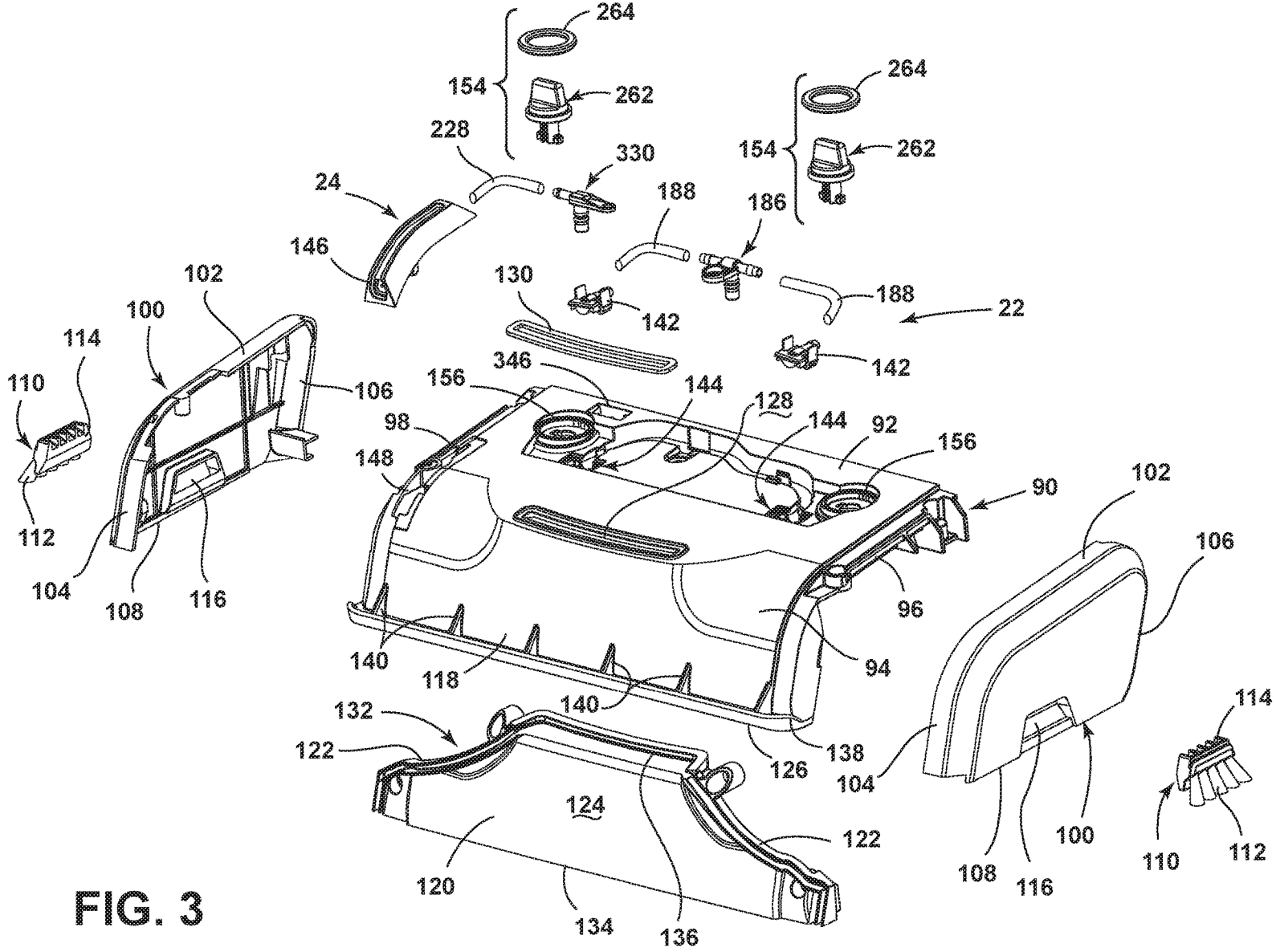
FIG. 3 is an exploded view of the modular nozzle/spray unit from FIG. 2.

FIG. 3 is an exploded view of the modular nozzle/spray unit 26 from FIG. 2. The unit 26 includes a main housing 90 having a top wall 92 and a front wall 94 joined to a front edge of the top wall 92, and a pair of lateral sides 96, 98. End caps 100 are removably mounted to the lateral sides 96, 98 of the main housing 90 by mechanical fasteners, such as with screws or detents.

The end caps 100 can substantially be mirror images of each other, and each end cap 100 has an elongated rectangular shape with an angled top side 102, curving front and rear sides 104, 106, and a bottom side 108 adapted to be positioned adjacent a surface to be cleaned. The end caps 100 can be translucent so that the agitator assembly 84 is at least partially visible to the user. The end caps 100 can also be colored for aesthetic purposes.

Optionally, the end caps 100 can carry agitators in the form of edge brushes 110. The edge brushes 110 can include a set of bristles 112 held by a bristle block 114. The edge brushes 110 can be mounted to the end caps 110 in any suitable manner, such as by a press-fit or with mechanical fasteners attaching the bristle block 114 to the end caps 100. In the illustrated example, the bristle blocks 114 are snap-fit into a correspondingly-shaped brush receiver aperture 116 in the respective end cap 100. The edge brushes 110 can further be removably mounted so that a user can remove the edge brushes 110 from the base assembly 12 for cleaning or replacement. The edge brushes 110 can be mounted such that the bristles 112 extend beyond the path of travel of the extraction cleaner 10 to extend the cleaning path of the extraction cleaner 10.

The extraction nozzle 28 can be formed by a forward wall 118 and a rearward wall 120 that are joined together by spaced side walls 122 to form a fluid flow path 124 therebetween. The fluid flow path 124 begins at an elongated nozzle opening 126 positioned adjacent a surface to be cleaned and terminates at an elongated outlet 128 surrounded by a gasket 130 at an upper portion of the extraction nozzle 28. The forward wall 118 and the elongated outlet 128 of the extraction nozzle 28 can be integrally formed with the main housing 90. As shown herein, the forward wall 118 can be defined by the front wall 94 of the main housing, and the outlet 128 can be formed in the top wall 92.

The rearward wall 120 and side walls 122 can be a separate nozzle frame 132 that is joined with the main housing 90. The nozzle frame 132 can include a nozzle opening 134 and an outlet 136 that respectively align with the nozzle opening 126 and outlet 128 provided in the main housing 90.

The forward wall 118 can be provided with a generally flat glide surface 138 at a lower portion thereof. The glide surface 138 rests on the surface to be cleaned and helps distribute the weight of the extraction cleaner 10 over a relatively large surface area, thereby reducing perceived exertion by the user during operation of the extractor 10. The forward wall 118 can further be provided with gussets 140 that stiffen the extraction nozzle 28.

The primary fluid distributor 22 includes at least one sprayer positioned to dispense fluid onto the surface to be cleaned. The at least one sprayer can dispense fluid directly onto the surface to be cleaned, such as by having an outlet of the sprayer positioned in opposition to the surface, or indirectly onto the surface to be cleaned, such as by having an outlet of the sprayer positioned to dispense into the agitator assembly. The at least one sprayer of the primary fluid distributor 22 is illustrated as two spray tips 142 removably mounted within spray tip receivers 144 formed on the top wall 92 of the main housing 90.

The auxiliary fluid distributor 24 includes at least one sprayer positioned to dispense fluid onto a more limited or smaller area of the surface to be cleaned than the primary fluid distributor. The at least one sprayer can dispense fluid directly onto the surface to be cleaned, such as by having an outlet of the sprayer positioned in opposition to the surface, or indirectly onto the surface to be cleaned, such as by having an outlet of the sprayer positioned to dispense onto the edge brushes. As shown herein, the at least one sprayer is positioned on the exterior of the unit 26 to spray forwardly of the extraction nozzle 28, such that both the sprayer and the fluid it dispenses is easily viewed by a user operating the extractor 10. This permits a user to see exactly where the spray from the auxiliary fluid distributor 24 strikes the surface to be cleaned, allowing for a more focused treatment of an area of the surface to be cleaned. This may be particularly useful when treating visible or hard-to-treat stains on the surface to be cleaned that are not sufficiently cleaned by the primary fluid distributor. As such, the primary fluid distributor 22 may be used during a normal cleaning operation to deliver cleaning fluid to the surface to be cleaned, while the auxiliary fluid distributor 24 may be used intermittently at a user's discretion to deliver a focused spray of cleaning fluid to a limited area of the surface of the cleaned separate and apart from the primary fluid distributor 22. The at least one sprayer of the auxiliary fluid distributor 24 is illustrated as a single spray assembly 146 removably mounted to a spray assembly receiver 148 provided on the unit 26.

At least one lock assembly 154 is provided for selectively locking and unlocking the unit 26 to the base assembly 12. As shown herein, two lock assemblies 154 are provided. The lock assemblies 154 can optionally include quick-release or quarter-turn lock assemblies for quickly coupling or decoupling the unit 26 and base assembly 12. The main housing 90 is provided with a unit lock retainer 156 for receiving the lock assembly 154.

Figure 4:
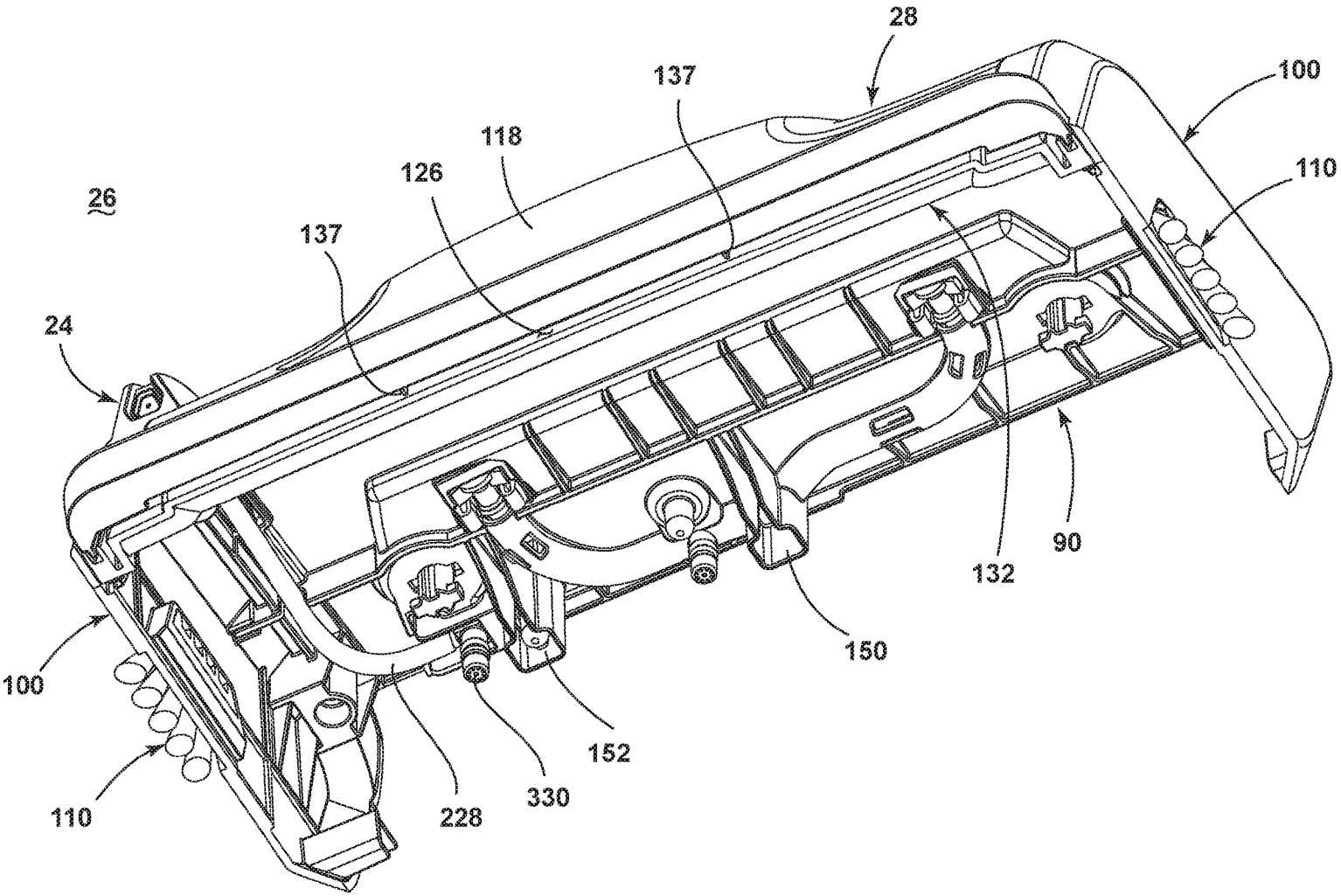
FIG. 4 is a bottom perspective view of the nozzle/spray unit from FIG. 3.

FIG. 4 is a bottom perspective view of the nozzle/spray unit 26 from FIG. 3. The nozzle frame 132 extends between the end caps 100 along the forward wall 118 of the main housing 90. The nozzle frame 132 is spaced from the forward wall 118 to define the nozzle opening 126 therebetween. The forward wall 118 further includes one or more ribs 137 which project rearwardly therefrom. As shown herein, two spaced ribs 137 are provided on the forward wall 118. The ribs 137 can span the nozzle opening 126 to abut or substantially abut the rearward wall 120, providing a structural support to the extraction nozzle 28 which prevents collapsing or deformation of the extraction nozzle 28 during use. While not shown herein, the one or more of the ribs 137 can be provided on the nozzle frame 132 to span the nozzle opening 126, rather than on the forward wall 118.

The nozzle/spray unit 26 can be provided with one or more features that aid in alignment of the nozzle/spray unit 26 with the base housing 60. One example of an alignment feature is shown herein as a first male fitting 150 and a second male fitting 152 which extends from the underside of the main housing 90. As illustrated, the male fittings 150, 152 can have a T-shape.

Figure 5:
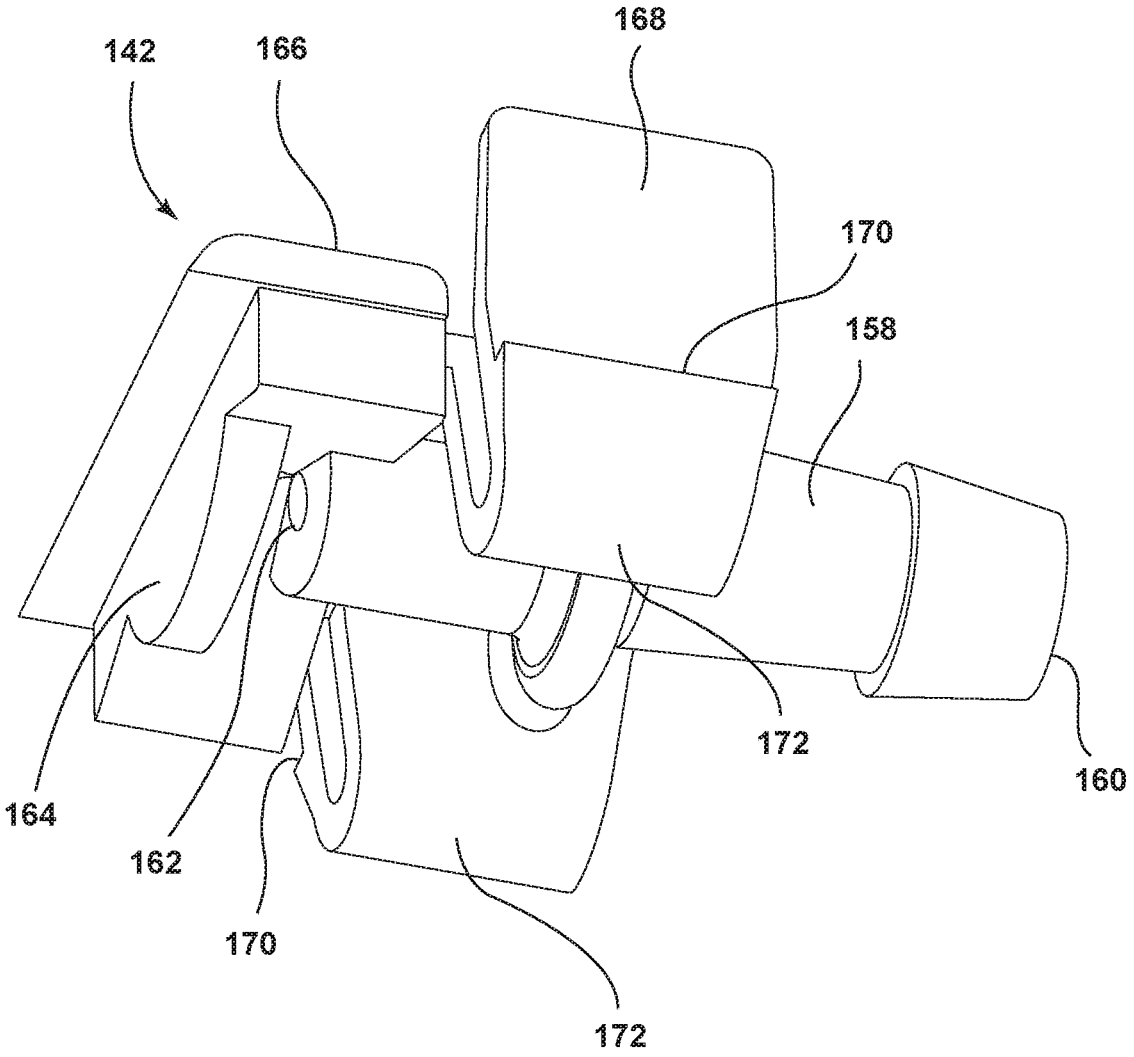
FIG. 5 is a bottom perspective view of a spray tip of the modular nozzle/spray unit from FIG. 3.

FIG. 5 is a bottom perspective view of one of the spray tips 142 from FIG. 3. Each spray tip 142 includes a spray tip conduit 158 that extends from a rearward inlet 160 to a forward outlet 162. Fluid that flows from the outlet 162 can be atomized by providing an atomizing wall 164 that depends from a generally planar base 166 integral with the spray tip conduit 158. Each spray tip 142 further includes a pair of resilient mounting tabs 168 having an outward facing prong 170 and an arcuate bend 172 about which the tabs 168 can flex toward towards the spray tip conduit 158.

Figure 6:
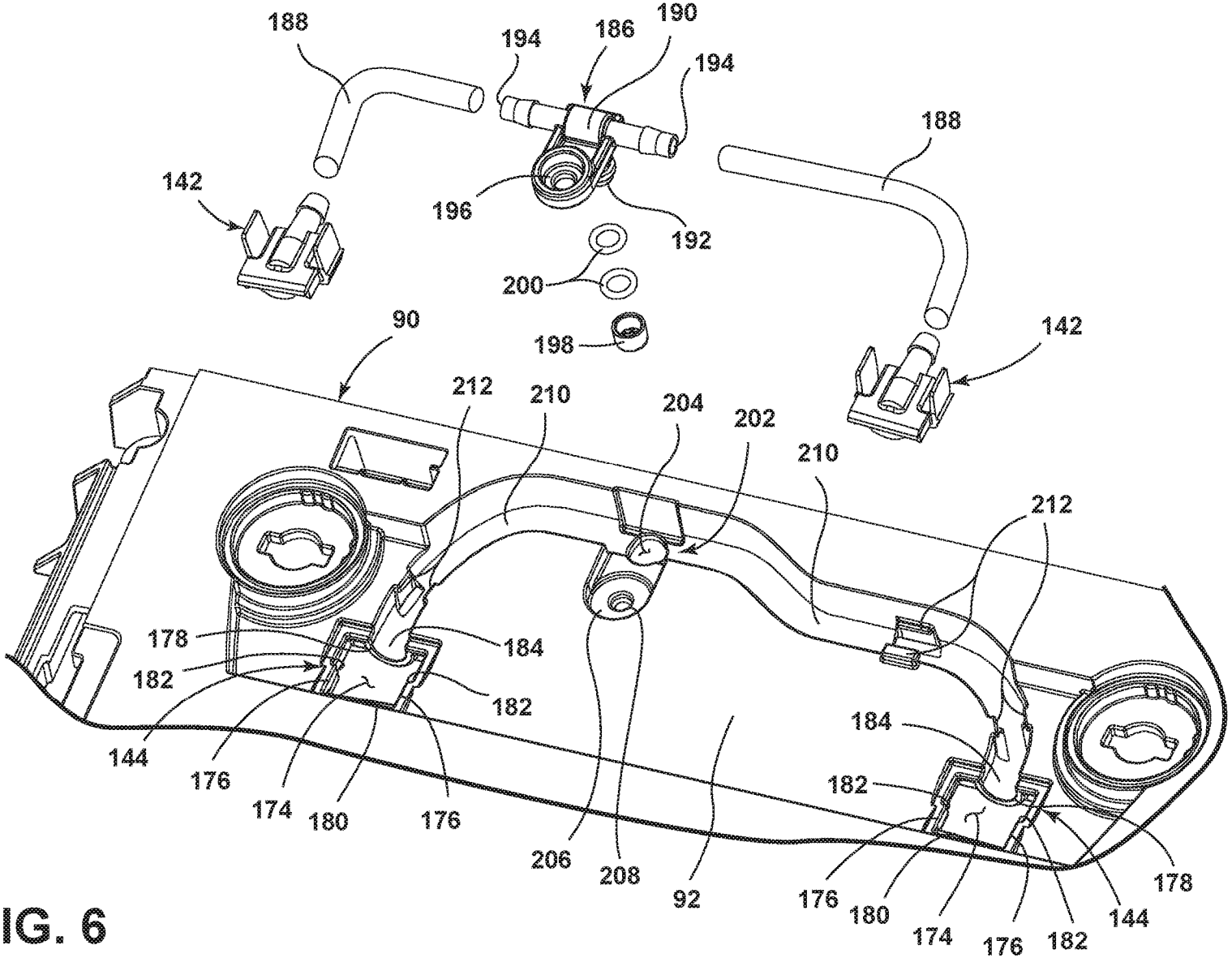
FIG. 6 is a partially exploded view of the modular nozzle/spray unit from FIG. 3, showing a portion of a primary fluid distributor system.

FIG. 6 is a partially exploded view of the modular nozzle/spray unit 26, showing a portion of a primary fluid distributor system. Each spray tip receiver 144 includes an opening 174 formed in the top wall 92 of the main housing 90 having a pair of spaced side walls 176 joined by a rear wall 178 and a front wall 180. The side walls 176 each include a notch 182, and the rear wall 178 includes a U-shaped opening 184. When mounted to the spray tip receivers 144, the spray tips 142 are in fluid communication with the interior of the unit 26 so that the fluid can be supplied from the spray tips 142 to the surface to be cleaned. As shown herein, the spray tips 142 are positioned to spray rearwardly of the extraction nozzle 28 within the interior of the unit 26. Each spray tip 142 is mounted in its respective spray tip receiver 144 with the resilient tabs 168 abutting the notches 182 and the prongs 170 positioned beneath and abutting the side walls 176, a portion of the planar base 166 resting on the front wall 180, and the spray tip conduit 158 held in the U-shaped opening 184.

The spray tips 142 can be connected to a common spray tee 186 by conduits 188. The spray tee 186 can act as a first coupling for connecting the spray tips 142 to the supply container 20 (FIG. 2) when the unit 26 is mounted to the base assembly 12. The spray tee 186 includes a T-shaped conduit 190 having a single inlet 192 and two outlets 194, each in communication with one of the spray tips 142. The spray tee 186 further includes a mounting boss 196 connected to the T-shaped conduit 190 which is used to connect the spray tee 186 to the main housing 90. A screen 198 can cover the inlet 192 to prevent particulate above a certain size, as determined by the opening size of the screen 198, from entering the spray tee 186. O-rings 200 are provided for sealing the inlet end of the T-shaped conduit 190 within a second coupling for the primary fluid distributor 22, described below, in communication with the supply container 20 (FIG. 2).

A spray tee receiver 202 can be formed on the top wall 92 of the main housing 90 and can removably mount the spray tee 186. The spray tee receiver 202 includes an opening 204 formed in the top wall 92 for receiving the inlet end of the T-shaped conduit 190, such that the inlet end of the T-shaped conduit 190 is internal to the unit 26 and the outlet ends of the T-shaped conduit 190 on the exterior of the unit 26. A circular recess 206 containing a blind hole 208 can be formed in the top wall 92 of the main housing 90, and is sized to receive the mounting boss 196 of the spray tee 186. A screw or other fastener (not shown) can be used to removably attach the spray tee 186 within the spray tee receiver 202. Alternatively, the spray tee 186 can be removably attached without the use of tools, such as by using a snap-fit connection.

Conduit receivers in the form of open-topped channels 210 can extend between the spray tee receiver 202 and the spray tip receivers 144, and can receive the outlet ends of the T-shaped conduit 190, and the conduits 188. One or more retaining tabs 212 can be provided within the channels 210 to hold the conduits 188 within the channels 210, such that the conduits 188 are below or flush with the top wall 92 of the main housing 90.

Figure 7:
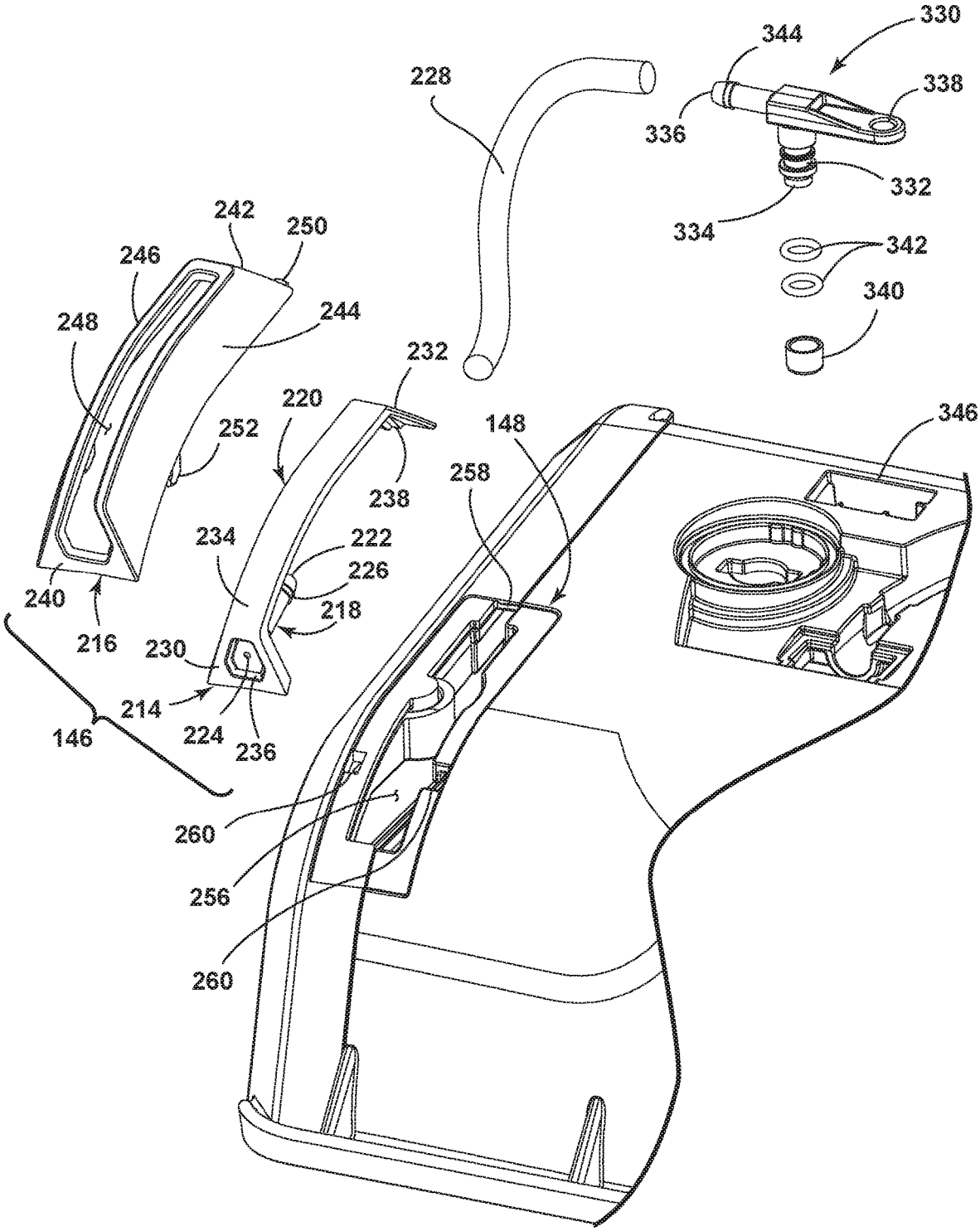
FIG. 7 is a partially exploded view of the modular nozzle/spray unit from FIG. 3, showing a portion of an auxiliary fluid distributor system.

FIG. 7 is a partially exploded view of the modular nozzle/spray unit 26, showing a portion of an auxiliary fluid distributor system. The spray assembly 146 includes a spray tip 214 that dispenses fluid onto the surface to be cleaned and a spray tip housing 216 that at least partially covers the spray tip 214 and substantially covers the spray assembly receiver 148. The spray tip 214 includes a spray tip conduit 218 and a cover 220 that at least partially covers the spray tip conduit 218. The spray tip conduit 218 extends from a rearward inlet 222 to a forward outlet 224. The inlet end of the conduit 218 can include barbs 226 that frictionally engage a flexible conduit 228 in fluid communication with a spray tee 330. The spray tee 330 can act as a first coupling for connecting the spray tip 214 to the supply container 20 (FIG. 2) when the unit 26 is mounted to the base assembly 12.

The spray tee 330 includes an L-shaped conduit 332 having a single inlet 334 and outlet 336. The spray tee 330 further includes a mounting boss 338 connected to the L-shaped conduit 332 which is used to connect the spray tee 330 to the main housing 90 using a fastener (not shown). A screen 340 can cover the inlet 334 to prevent particulate above a certain size, as determined by the opening size of the screen 340, from entering the spray tee 330. O-rings 342 are provided for sealing the inlet end of the L-shaped conduit 332 within a second coupling for the auxiliary fluid distributor 24, described below, in communication with the supply container 20 (FIG. 2). The outlet-end of the conduit 336 can include barbs 344 that frictionally engage the flexible conduit 228 in fluid communication with a spray tip 214. The spray tee 330 is attached to the underside of the main housing 90, which has an access port 346 formed in the top wall 92 thereof by which the fastener (not shown) within the mounting boss 338 can be accessed to remove or install the spray tee 330 within the unit 26.

The cover 220 includes an angled front wall 230 and an angled rear wall 232, and a slightly bowed top wall 234 joining the front and rear walls 230, 232. As illustrated, the conduit 218 is integrally formed with the front wall 230, and extends backwardly from a rear face of the front wall 230, with the spray tip inlet 222 provided at the distal end of the conduit 218. A front face of the front wall 230 includes a depression 236 in which the spray tip outlet 224 is formed. A rear face of the rear wall 232 includes a groove 238.

The spray tip housing 216 can include a shell having an angled front wall 240 and an angled rear wall 242 joined by spaced angled side walls 244 and a slightly bowed top wall 246. An elongated opening 248 is formed in housing 216, and can extend through the front and top walls 240, 246. The spray tip 214 is seated within the housing 216, such that the front, rear, and top walls 230, 232, 234 of the spray tip cover 220 confront the front, rear, and top walls 240, 242, 246 of the housing 216, respectively, and such that a portion of the front and top walls 230, 234 of the spray tip cover 220 is visible through the opening 248. A rear mounting tab 250 extends from the rear wall 242, and two front mounting tabs 252 extend downwardly from the side walls 244. An inner face of the rear wall 242 includes a projection (not shown) configured to fit within the groove 238 on the rear wall 232 of the spray tip cover 220.

The spray assembly receiver 148 includes an opening 256 formed in the unit 26. The opening 256 includes a rear slot 258 for receiving the rear mounting tab 250 on the cover 220, and two front slots 260 for receiving the front mounting tabs 252 on the cover 220. The opening 256 can be formed in the main housing 90, one of the end caps 100, or a combination of both the main housing 90 and one of the end caps 100, as shown herein.

Figure 8:
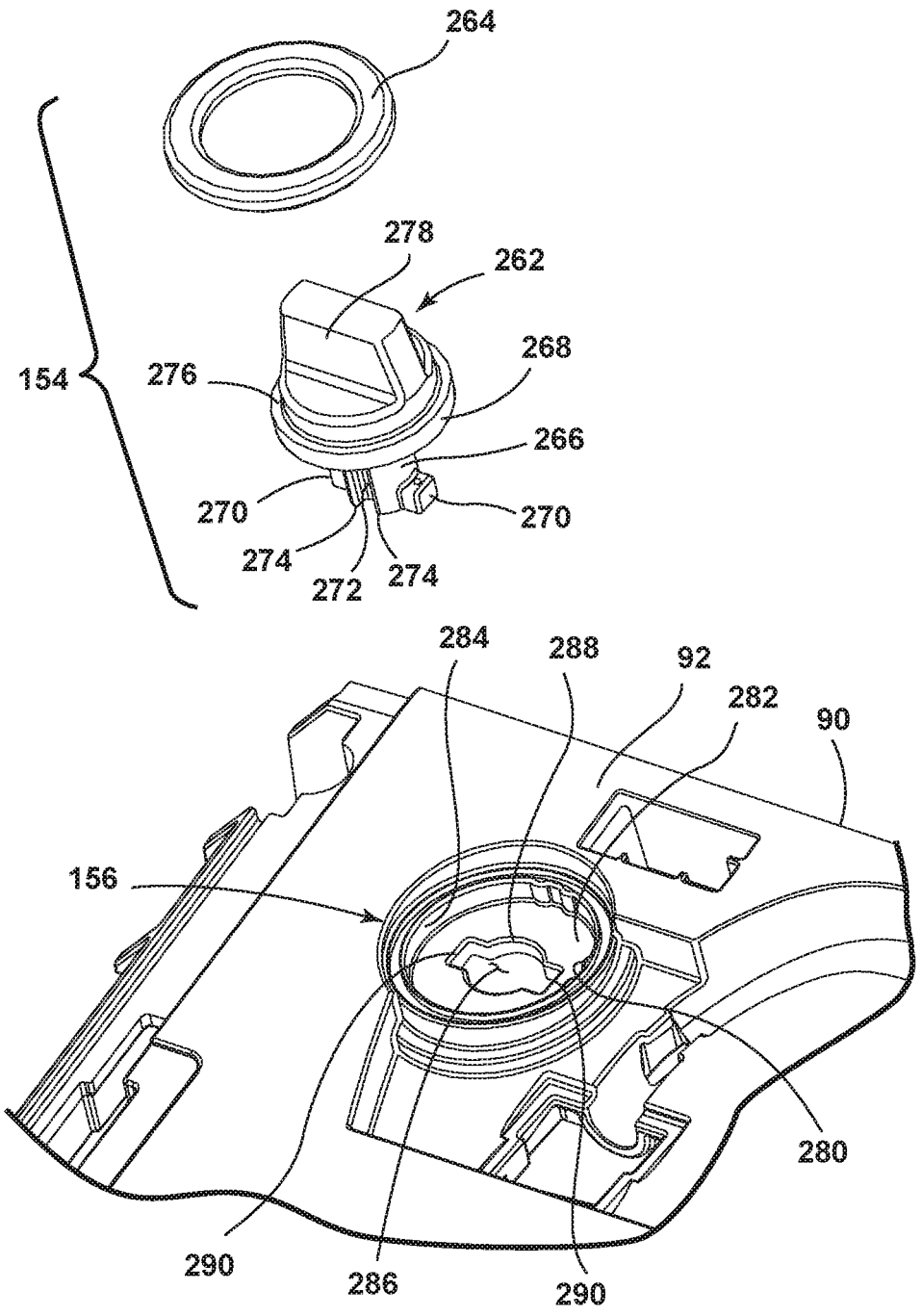
FIG. 8 is a partially exploded view of the modular nozzle/spray unit from FIG. 3, showing a portion of a locking system.

FIG. 8 is a partially exploded view of the modular nozzle/spray unit 26, showing a portion of a locking system. As shown herein, each lock assembly 154 includes a lock 262 and a lock cover 264. The lock cover 264 can be affixed to the top of the unit lock retainer 156 to rotatably retain the lock 262 therebetween. The lock 262 can include a shank 266 and a head 268 provided on one end of the shank 266. The opposite end of the shank 266 includes a pair of diametrically opposed locking projections 270. The shank 266 also includes a pair of opposed flats 272 formed between spaced shoulders 274 extending along the length of the shank 266. The head 268 includes a circular base 276 having a grip portion 278 provided on an upper surface of the base 278. The shank 266 depends from a lower surface of the base 276. The lock cover 264 can be annular in shape, and can be received on the base 276, surrounding the grip portion 278.

The unit lock retainer 156 can include a circular depression 280 defined by a bottom wall 282 and a peripheral side wall 284, and a hole 286 formed in the bottom wall 282. The hole 286 is defined by a central portion 288 configured to receive the shank 266 and a two diametrically opposed radial portions 290 configured to accommodate the locking projections 270.

Figure 9:
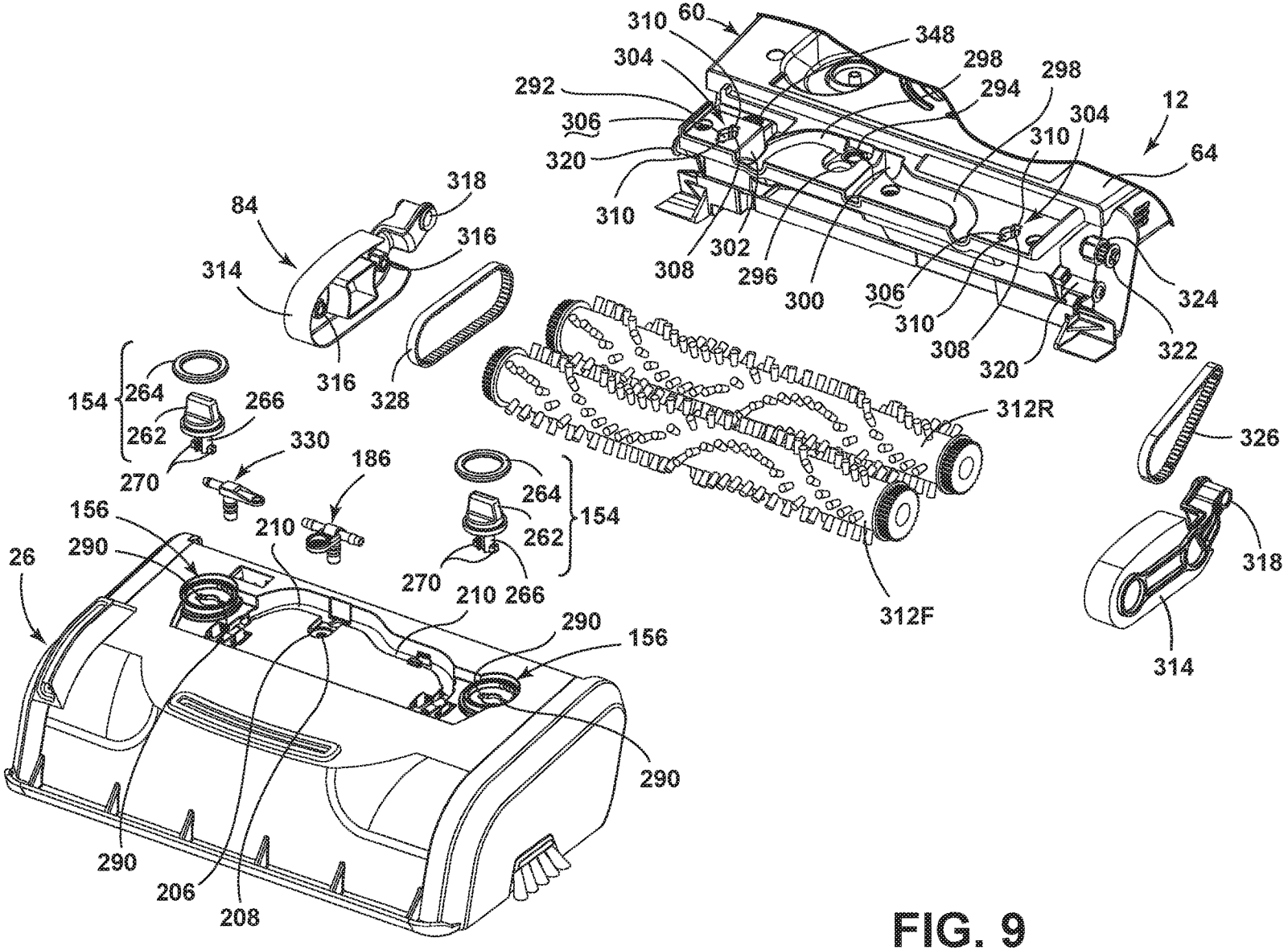
FIG. 9 is a partially exploded view of the base assembly and the modular nozzle/spray unit from FIG. 2, showing an agitation assembly and a further portion of the locking system.

FIG. 9 is a partially exploded view of the base assembly 12 and the modular nozzle/spray unit 26, showing the agitation assembly 84 and a further portion of the locking system. The base housing 60 can be provided with associated conduits, connections, and/or fittings for coupling the components of the nozzle/spray unit 26 to corresponding components in the base housing 60. The base housing 60 can also have associated connections and/or fittings for coupling the agitator assembly 84 to the agitator motor 86 (FIG. 2). The base housing 60 includes a supporting platform 292 extending from a front portion of the upper housing piece 64, on which the nozzle/spray unit 26 can be at least partially supported. A coupling for the primary fluid distributor 22 in the form of a first spray tee socket 294 is provided in the platform 292 and is in fluid communication with the fluid supply container 20 (FIG. 2) via a fluid conduit (not shown). The spray tee socket 294 can removably couple with the spray tee 186, thereby placing the spray tee 186 in fluid communication with the fluid supply container 20. The O-rings 200 (FIG. 6) seal the inlet end of the T-shaped conduit 190 of the spray tee 186 within the spray tee socket 294. The platform 292 includes a recess receiver 296 near the first spray tee socket 294 which can receive the recess 206 and the blind hole 208 used to fasten the spray tee 186 within the spray tee receiver 202. The platform 292 further includes channel receivers 298 which extend from the first spray tee socket 294 and can receive the channels 210 in the main housing 90. A coupling for the auxiliary fluid distributor 24 in the form of a second spray tee socket 348 is also provided in the platform 292 and is in fluid communication with the fluid supply container 20 (FIG. 2) via a fluid conduit (not shown). The spray tee socket 348 can removably couple with the spray tee 330, thereby placing the spray tee 186 in fluid communication with the fluid supply container 20. The O-rings 342 (FIG. 7) seal the inlet end of the L-shaped conduit 332 of the spray tee 330 within the spray tee socket 348.

The platform 292 can further be provided with one or more features that aid in alignment of the nozzle/spray unit 26 with the base housing 60. One example of an alignment feature is shown herein as a first female fitting 300 and a second female fitting 302 formed in the platform 292 and which receive the first male fitting 150 and a second male fitting 152 (FIG. 4), respectively, on the underside of the nozzle/spray unit 26. As illustrated, the female fittings 300, 302 can have a T-shape corresponding to the male fittings 150, 152.

The platform 292 can further include a base lock retainer 304 for receiving the lock assembly 154 of the unit 26 and positioned to be aligned with the unit lock retainer 156 when the unit 26 is secured to the base housing 60. The base lock retainer 304 can have substantially the same configuration as the unit lock retainer 156, with a hole 306 defined by a central portion 308 configured to receive the shank 266 and a two diametrically opposed radial portions 310 configured to accommodate the locking projections 270 of the lock 262. However, the base lock retainer 304 can be offset from the unit lock retainer 156 such that the lock 262 can be removed from the base lock retainer 304 but will not pull out of the unit lock retainer 156. As shown herein, the base lock retainer 304 and the unit lock retainer 156 are offset by approximately 90°, such that the radial portions 310 are spaced approximately 90° from the radial portions 290.

The agitator assembly 84 is illustrated as a pair of brushrolls 312 rotatable about a horizontal axis; however, it is within the scope of the present disclosure for other types of agitators to be used, including, but not limited to, a single horizontally-rotating brushroll, at least one stationary brush, at least one brush that is rotatably mounted about a vertical axis, a sponge-type roller, and a disposable cleaning pad or cloth. The agitator assembly 84 can be positioned within an agitator chamber defined by the main housing 90 of the unit 26 for rotational movement. The downwardly-facing agitator chamber is provided to the rear of the nozzle frame 132, between the end caps 100.

The brushrolls 312 can be pivotally mounted to the base housing 60 as a set by swivel arms 314. The swivel arms 314 include bearing surfaces 316 on which the ends of the brushrolls 312 can be rotatably mounted, and a sleeve 318 which can be received on pivot shafts 320 provided on the base housing 60. The swivel arms 314 extend into the nozzle/spray unit 26, allowing the agitator assembly 84 to be accommodated within the nozzle/spray unit 26, while being supported by the base housing 60 independently of the nozzle/spray unit 26. The swivel arms 314 permit the brushrolls 312 to pivot as a set about an axis defined by the pivot shafts 320 and thereby float over the surface to be cleaned.

The agitator motor 86 (FIG. 2) within the base housing 60 can include a motor shaft 322 which extends exteriorly of the base housing 60. A pulley 324 can be provided on the exterior portion of the motor shaft 322. A drive belt 326 couples the pulley 324 to the rear brushroll 312R to transmit the rotational force provided by the motor shaft 322 to the rear brushroll 312R. A coupling belt 328 couples the rear brushroll 312R to the front brushroll 312F to transmit the rotational force provided by the motor shaft 322 from the rear brushroll 312R to the front brushroll 312F. Optionally, the coupling belt 328 can be adapted to rotate the brushrolls 312 in the same or opposite directions.

The nozzle/spray unit 26 is modular in nature, such that the unit 26 is composed of a standardized unit for easy assembly with the extraction cleaner 10. The standardized unit can further be easily removable from the extraction cleaner 10 in order to access, clean, repair, or replace the components of the standardized unit. For example, upon removal of the nozzle/spray unit 26 from the base assembly 12, the agitator assembly 84 can be accessed, such as to clean hair or other debris from the brushrolls 312, or to change the belts 326, 328. Furthermore, the entire nozzle/spray unit 26 can be interchanged with another similar unit, such as to change, upgrade, or replace the fluid distribution, agitation, and extraction features of the extraction cleaner. Also, the extraction nozzle 28, spray tips 142, 214, and other associated fluid delivery components can easily be accessed for cleaning if they become clogged or blocked.

To remove the nozzle/spray unit 26, the recovery tank 30 is removed from the extraction cleaner 10, exposing the lock assemblies 154 as shown in FIG. 9; the lock assemblies 154 are covered by the recovery tank 30 when the recovery tank 30 is mounted on the extraction cleaner 10, as shown in FIG. 1. The lock assemblies 154 are turned until the locking projections 270 are aligned with the radial projections 310 of the base lock retainer 304; this position of the lock assemblies 154 can be considered an "unlocked" position. The nozzle/spray unit 26 can then be lifted off the supporting platform 292. The lock assemblies 154 will not pull out of the unit lock retainers 156 in the "unlocked" position because of the offset between the base and unit lock retainers 304, 156. As the nozzle/spray unit 26 is lifted, the locks 262 will clear the base lock retainer 304, the male fittings 150, 152 (FIG. 4) will be unseated from the female fittings 300, 302, the spray tee 186 will disengage from the first spray tee socket 294, and the spray tee 330 will disengage from the second spray tee socket 348.

Figure 10:
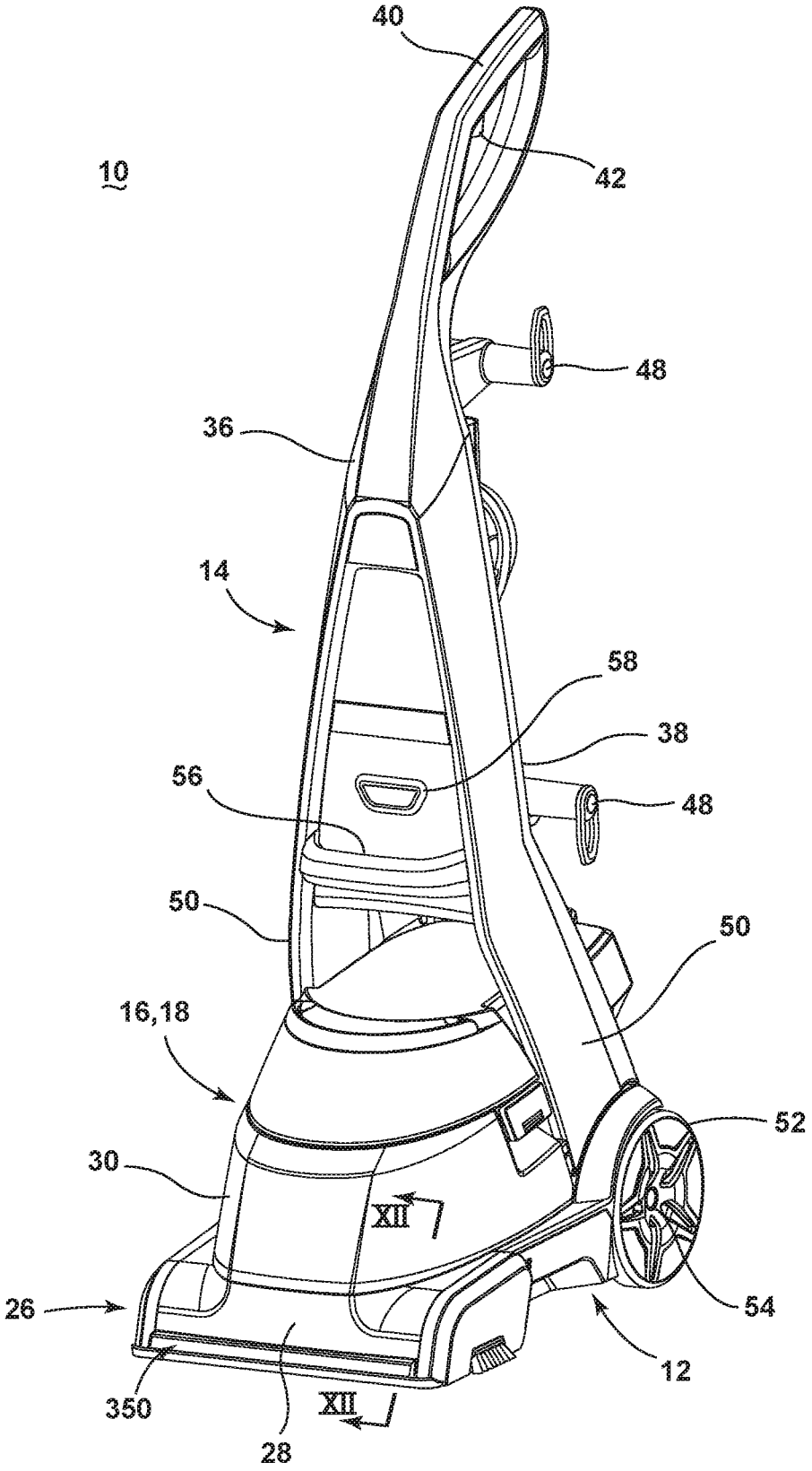
FIG. 10 is a front perspective view of an extraction cleaner according to a second example of the present disclosure.

FIG. 10 is a front perspective view of an extraction cleaner 10 according to a second example of the present disclosure. The second example of the extraction cleaner 10 can be similar to the first example, and like elements are identified with the same reference numerals. In the second example, an auxiliary fluid distributor is not provided, and so the extraction cleaner 10 lacks the spray assembly 146 and associated button 44 provided in the first example. The modular nozzle/spray unit 26 lacks the ribs 137 and gussets 140 of the first example, and can instead be provided with one or more stiffening elements 350. The stiffening element 350 can include a substantially inflexible brace provided on the unit 26. By being "substantially inflexible", the stiffening element 350 stiffens the forward wall 118 and rearward wall 120 around the nozzle opening 126 to prevent collapsing or deformation of the extraction nozzle 28 during use, without flexing or moving to a degree that would allow the nozzle opening 126 to collapse or the extraction nozzle 28 to deform. The stiffening element 350 can be manufactured from plastic or metal.

Figure 11:
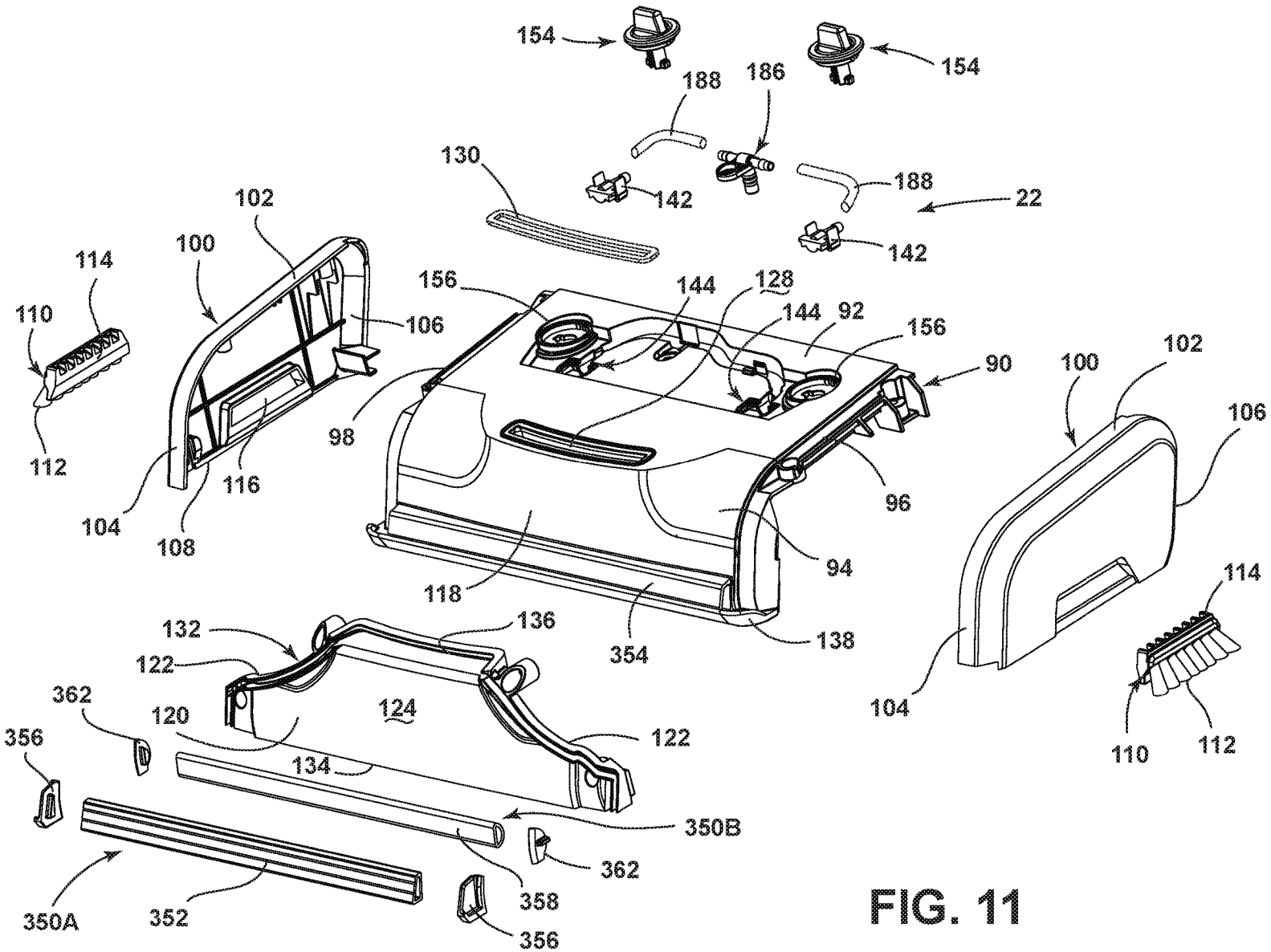
FIG. 11 is an exploded view of a modular nozzle/spray unit of the extraction cleaner from FIG. 10.

FIG. 11 is an exploded view of the modular nozzle/spray unit 26 from FIG. 10. As illustrated, the at least one stiffening element 350 includes an exterior stiffening element 350A and an interior stiffening element 350B. The exterior stiffening element 350A extends or substantially extends across the width of the extraction nozzle 28, and includes an exterior tubular brace 352 provided on the forward wall 118 of the extraction nozzle 28. The forward wall 118 can be provided with a sleeve 354 on its forward surface which defines a hollow cavity for receiving the brace 352. The sleeve 354 can be open-ended, the open ends of the sleeve 354 can be covered by caps 356 to enclose the brace 352.

The interior stiffening element 350B extends or substantially extends across the width of the extraction nozzle 28, and includes an interior tubular brace 358 provided on the nozzle frame 132 of the extraction nozzle 28. The nozzle frame 132 can be provided with a sleeve 360 on its rearward surface which defines a hollow cavity for receiving the brace 358. The sleeve 360 can be open-ended, the open ends of the sleeve can be covered by caps 362 to enclose the brace 358.

While both braces 352, 358 are illustrated herein as being tubular, it is also possible to use a substantially solid or flat brace. Furthermore, the braces 352, 358 can be insert-molded or can include a separate component that can be mechanically attached to the nozzle halves by a suitable method, some non-limiting examples of which include welding, heat-staking or adhesion.

Figure 12:
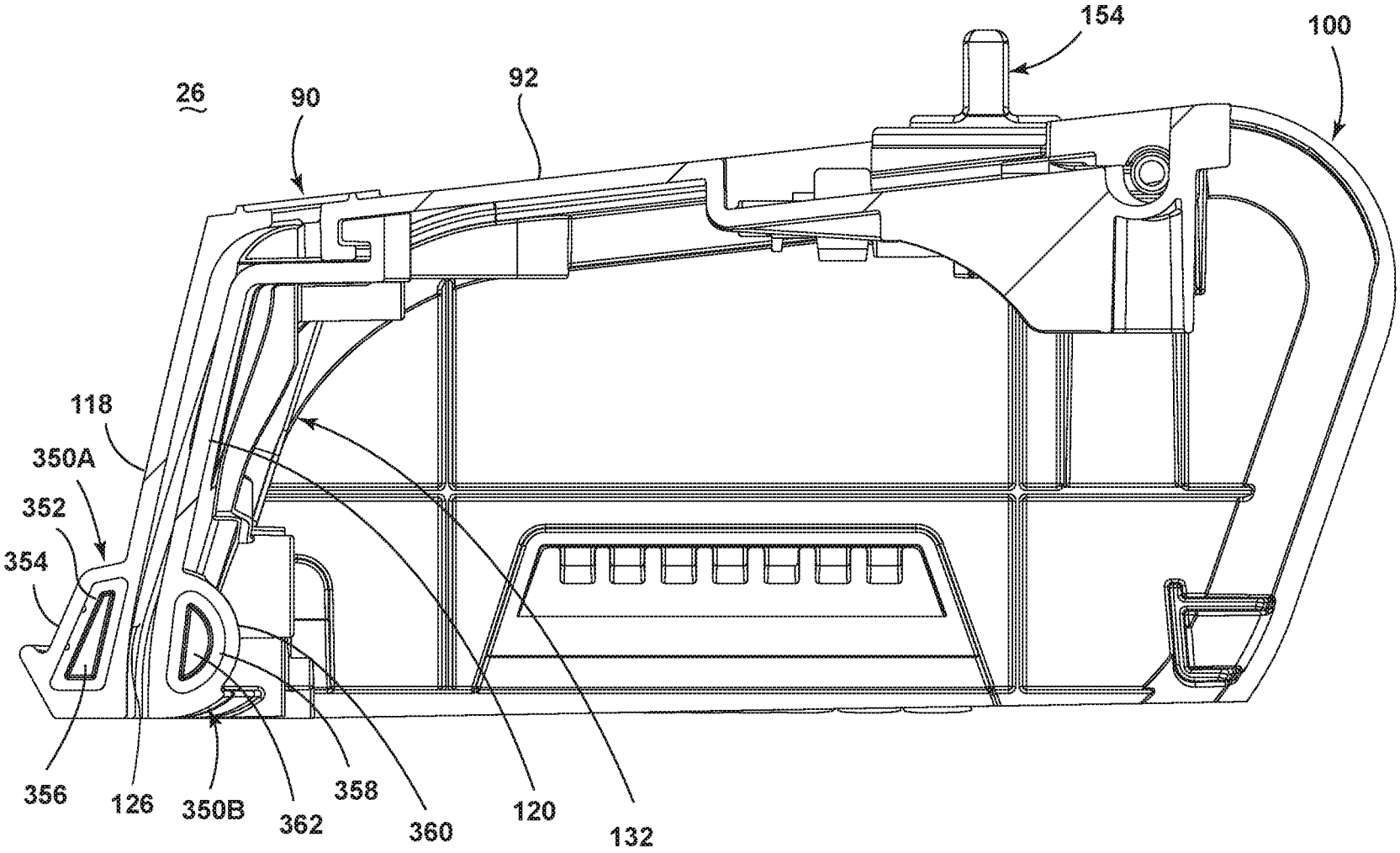
FIG. 12 is a cross-sectional view through line XII-XII of FIG. 10.

FIG. 12 is a cross-sectional view through line XII-XII of FIG. 10. The exterior tubular brace 352 can have a generally trapezoidal cross-sectional shape, while the interior tubular brace 358 can have a generally semi-cylindrical cross-sectional shape. Due to the presence of the stiffening elements 350A, B, the ribs 137 (FIG. 4) that span the nozzle opening 126 of the first example can be eliminated, thereby reducing potential for hair and/or other debris to collect around the ribs 137 and clog the nozzle opening 126.

Figure 13:
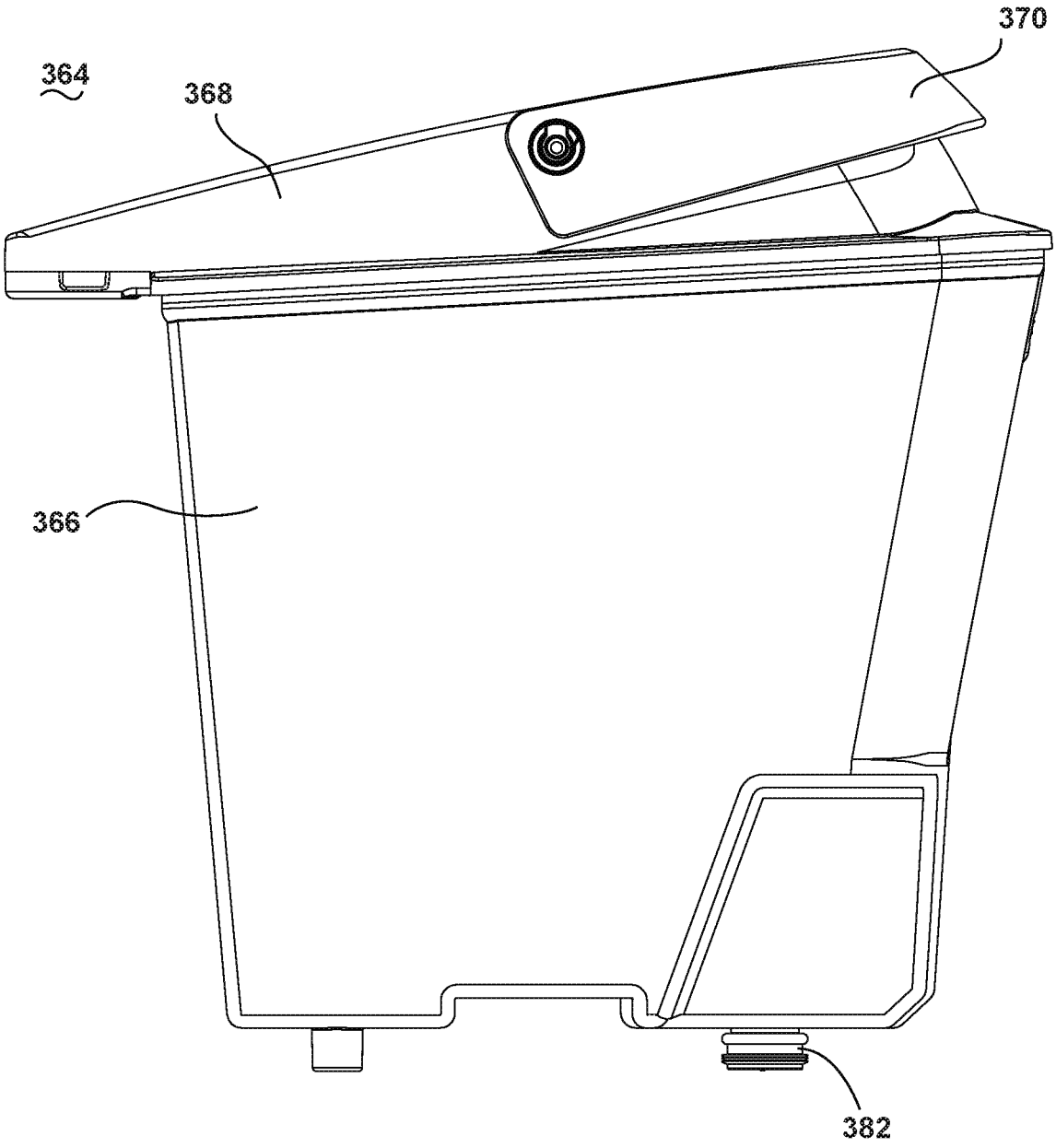
FIG. 13 is a side view of a tank assembly for an extraction cleaner according to third example of the present disclosure.

FIG. 13 is a side view of a tank assembly 364 according to a third example of the present disclosure. The tank assembly 364 can be used in place of the recovery tank 30 and fluid supply container 20 on the extraction cleaner 10 of the first and second examples of the present disclosure, shown in FIGS. 1 and 10, respectively, and includes a tank housing 366 that can be closed by a lid 368. The lid 368 can include a handle 370 for carrying the recovery tank assembly 364 when it is separated from the base assembly 12 (FIG. 1 or 10).

Figure 14:
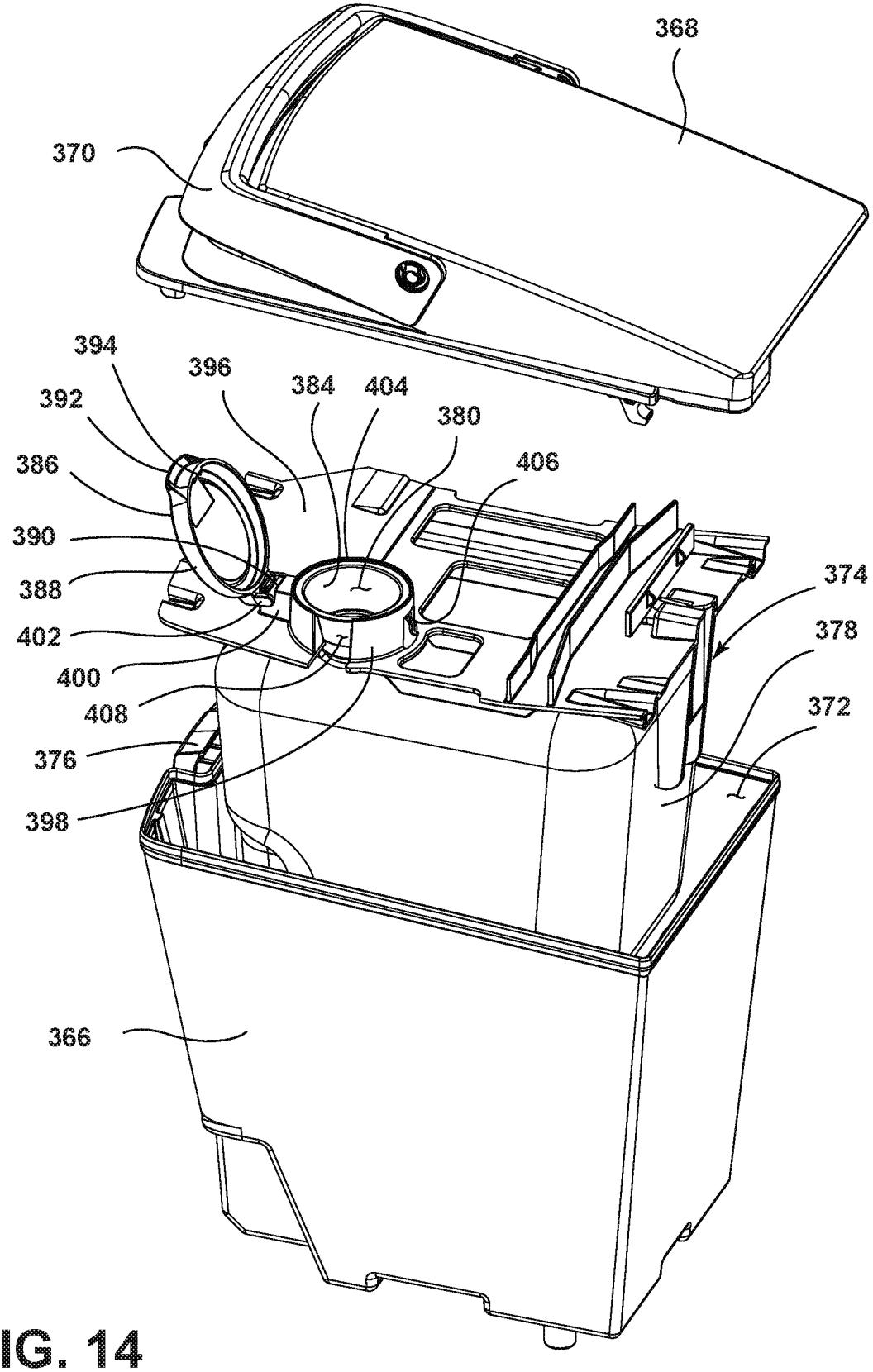
FIG. 14 is a partially exploded view of the tank assembly from FIG. 13, illustrating a fill cap of the tank assembly in an open position.

FIG. 14 is a partially exploded view of the tank assembly 364 from FIG. 13. The tank housing 366 acts as a recovery tank and defines a recovery chamber 372 used to store spent cleaning fluid and dirt that is recovered from the surface to be cleaned. The tank assembly 364 further includes a fluid supply container 374 that is received within the tank housing 366 and enclosed by the lid 368. The lid 368 can be selectively attached to the tank housing 366 by a latch assembly 376. The lid 368 can include a separator (not shown) for separating spent cleaning fluid and dirt from a working airflow and depositing the fluid and dirt into the recovery chamber 372.

The tank housing 366 is sized to receive the fluid supply container 374, illustrated herein as a flexible bladder 378 that stores a cleaning fluid. The cleaning fluid can include any suitable cleaning fluid, including, but not limited to, water, concentrated detergent, diluted detergent, and the like. The bladder 378 includes an inlet 380 and an outlet (not shown) that is secured to a valve mechanism 382 (FIG. 13) for controlling flow of the cleaning fluid from the bladder 378. The valve mechanism 382 can project exteriorly of the tank housing 366 to be received by the valve receiver 78 (FIG. 2).

The inlet 380 of the bladder 378 can be defined by an inlet spout 384 extending from the bladder 378. A fill cap 386 can be provided for selectively covering the inlet spout 384 of the bladder 378. By covering the inlet spout 384, the fill cap 386 is configured to prevent recovered spent cleaning fluid in the recovery chamber 372 from mixing with the cleaning fluid inside the bladder 378 as the recovered spent cleaning fluid is deposited into the recovery chamber 372 from the separator (not shown) or as the fluid sloshes around the inside of the recovery chamber 372 during operation of the extraction cleaner 10.

The fill cap 386 includes a disk shaped member with a vertical lip 388 formed around the perimeter. A mounting portion and release portion are formed on diametrically opposed portions of the lip 388. The mounting portion is illustrated as a mounting pin 390 and the release portion is illustrated as a release tab 392 with a retainer hook 394 protruding inwardly from the lip 388, adjacent to the release tab 392.

Figure 15:
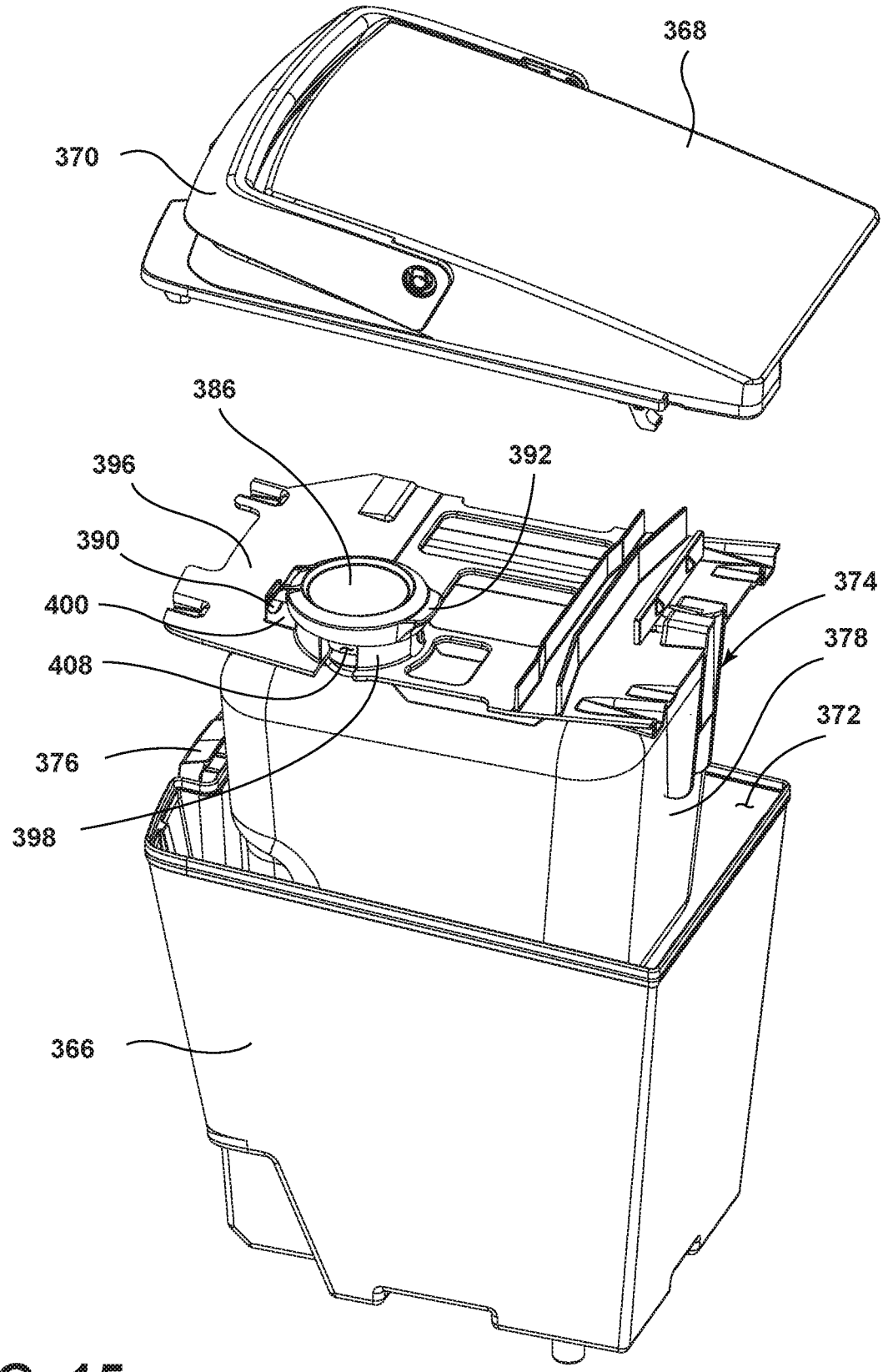
FIG. 15 is a view similar to FIG. 14, illustrating the fill cap in a closed position.

A baffle member 396 seated in the tank housing 366 mounts and retains the bladder 378 in the chamber 372. The baffler member 396 includes a hollow neck 398 that seats and retains the inlet spout 384 of the bladder 378 and a retainer 400 that extends from the neck 398 for pivotally mounting the fill cap 386. The retainer 400 is illustrated in the present example as having a C-shaped bearing 402 in which the mounting pin 390 is snap-fit for pivotal movement within the bearing 402. The mounting pin 390 of the fill cap 386 is received within the bearing 402 so that the fill cap 386 can be pivoted between an open position shown in FIG. 14 to expose the inlet spout 384 and a closed position, shown in FIG. 15 to cover the inlet spout 384. In the closed position, the fill cap 386 seals against a rim 404 at the top of the neck 398 of the baffle member 396. A recessed catch 406 on a forward portion of the neck 398 is configured to retain the hook 394 on the fill cap 386 when the fill cap 386 is seated in the closed position. The neck 398 of the baffle member 396 further includes a vent slot 408 for venting air under the fill cap 386 when the fill cap 386 is in the closed position so that air can flow into the bladder 378 and displace the cleaning fluid flowing out of the bladder 378.

In use, as the extraction cleaner 10 is maneuvered across the surface to be cleaned, recovered spent cleaning fluid is deposited into the recovery chamber 372 from the separator (not shown) in the lid 368. The recovered spent cleaning fluid within the recovery chamber 371 can slosh and splatter against the bladder 378 within the tank housing 366. When the fill cap 386 is in the closed position, the fill cap 386 blocks the recovered spent cleaning fluid from entering the inlet spout 384 and mixing with the cleaning liquid stored in the bladder 378. When the cleaning fluid within the bladder 378 is expended, a user can access the bladder by opening the lid 368 of the tank housing 366 and then opening the fill cap 386 and filling the bladder 378 through the exposed inlet spout 384. To open the fill cap 386, a user can pull upwardly on the release tab 392, which deflects the hook 384 over the catch 406 and permits the fill cap 386 to be pivoted upwardly and rearwardly to expose the inlet spout 384 for refilling.

The disclosed embodiments are representative of preferred forms of the present disclosure and are intended to be illustrative rather than definitive of the invention. The illustrated upright extractor is but one example of the variety of deep cleaners with which this invention or some slight variant can be used. Reasonable variation and modification are possible within the forgoing disclosure and drawings without departing from the scope of the invention which is defined by the appended claims.

What is claimed is:

1. An extraction cleaner for a floor surface, comprising:

a first housing having a base assembly with a first retainer, the base assembly configured for movement across the floor surface and a handle assembly pivotally mounted to a rearward portion of the base assembly for directing the base assembly across the floor surface;

at least one brushroll provided with the base assembly;

a fluid recovery system at least partially supported by the first housing, the fluid recovery system comprising:

a recovery tank for storing spent cleaning fluid and dirt that is recovered from the floor surface;

a suction source configured to generate a working airflow; and an extraction nozzle extending towards a surface to be cleaned and in fluid communication with the recovery tank;

a secondary housing removably mounted to the base assembly, the secondary housing including the extraction nozzle and a second retainer, wherein the at least one brushroll is mounted to and supported by the first housing independent the secondary housing, wherein the extraction nozzle is removed from the base assembly when the secondary housing is removed and wherein removal of the secondary housing from the base assembly exposes the at least one brushroll; and at least one lock assembly provided for selectively coupling the secondary housing to the base assembly, the at least one lock assembly having a body configured to be selectively received within the first retainer and the second retainer.

2. The extraction cleaner of claim 1 wherein the lock assembly comprises a quarter-turn lock for coupling the secondary housing and base assembly.

3. The extraction cleaner of claim 1 wherein the at least one lock assembly comprises two spaced lock assemblies and wherein when the recovery tank is mounted to the base assembly the recovery tank overlies the two spaced lock assemblies and the two spaced lock assemblies are inaccessible to a user.

4. The extraction cleaner of claim 1 wherein the at least one lock assembly includes a shank configured to be selectively received within the first retainer and the second retainer when the secondary housing is mounted to the first housing.

5. The extraction cleaner of claim 4 wherein the first housing further comprises a supporting platform extending from a front portion thereof and the secondary housing can be at least partially supported on the supporting platform when the secondary housing is mounted to the first housing.

6. The extraction cleaner of claim 4 wherein the secondary housing comprises a unit lock retainer defining the second retainer including a depression within the secondary housing and an opening located therein for receiving the shank.

7. The extraction cleaner of claim 6 wherein the base assembly comprises a base lock retainer defining the first retainer that is aligned with the unit lock retainer for receiving the shank when the secondary housing is mounted to the base assembly.

8. The extraction cleaner of claim 6, further comprising a lock cover selectively affixable to a top of the unit lock retainer and configured to rotatably retain the at least one lock assembly.

9. The extraction cleaner of claim 1 wherein the base assembly comprises a first alignment feature and the secondary housing comprises a second alignment feature that is configured to mate with the first alignment feature when the secondary housing is mounted to the base assembly.

10. The extraction cleaner of claim 1, further comprising a fluid delivery system including at least one fluid distributor in fluid communication with a supply container for depositing a cleaning fluid onto the floor surface wherein an outlet of the at least one fluid distributor is provided on the secondary housing and wherein the at least one fluid distributor and the extraction nozzle are simultaneously removable from the base assembly by removal of the secondary housing from the first housing.

11. An extraction cleaner for a floor surface, comprising:

a first housing having a base assembly with a first mounting feature provided in an upwardly-facing wall of the first housing, the base assembly configured for movement across the floor surface and a handle assembly pivotally mounted to a rearward portion of the base assembly for directing the base assembly across the floor surface;

a fluid recovery system at least partially supported by the first housing, the fluid recovery system, comprising:

a recovery tank for storing spent cleaning fluid and dirt that is recovered from the floor surface;

an extraction nozzle extending towards a surface to be cleaned and in fluid communication with the recovery tank; and a suction source in fluid communication with the recovery tank and configured to generate a working airflow through the extraction nozzle and into the recovery tank; and a modular unit having a secondary housing that is removably mounted to the base assembly, the secondary housing including a second mounting feature extending from a portion of an underside of the secondary housing that confronts the upwardly-facing wall of the first housing when mounted to the base assembly, complimentary with the first mounting feature, and the extraction nozzle; wherein, when the modular unit is mounted to the base assembly, the first mounting feature retains the second mounting feature; and wherein the second mounting feature is forward of a rear edge of the secondary housing at the location of the second mounting feature.

12. The extraction cleaner of claim 11, further comprising a fluid delivery system including at least one fluid distributor in fluid communication with a supply container for depositing a cleaning fluid onto the floor surface wherein an outlet of the at least one fluid distributor is provided on the modular unit and wherein the at least one fluid distributor and the extraction nozzle are simultaneously removable from the base assembly by removal of the secondary housing from the first housing.

13. The extraction cleaner of claim 11 wherein the first mounting feature is a female-fitting and the second mounting feature is a corresponding male-fitting receivable within the female-fitting.

14. The extraction cleaner of claim 13 wherein the first mounting feature and the second mounting feature both have a T-shaped profile.

15. The extraction cleaner of claim 11, further comprising a lock assembly for selectively locking and unlocking the modular unit to the base assembly.

16. The extraction cleaner of claim 15 wherein the recovery tank is removably mounted to the base assembly, and the recovery tank covers the lock assembly when the recovery tank is mounted the base assembly such that the lock assembly is inaccessible to a user.

17. The extraction cleaner of claim 15 wherein the lock assembly comprises a quarter-turn lock and a first retainer is configured to receive the quarter-turn lock.

18. The extraction cleaner of claim 17 wherein the first housing of the base assembly comprises a base lock retainer that is aligned with the first retainer when the modular unit is mounted to the base assembly and wherein the base lock retainer is further configured to selectively receive the quarter-turn lock.

19. An extraction cleaner for a floor surface, comprising:

a first housing having a base assembly with a first retainer, the base assembly configured for movement across the floor surface and a handle assembly pivotally mounted to a rearward portion of the base assembly for directing the base assembly across the floor surface;

a fluid recovery system at least partially supported by the first housing, the fluid recovery system comprising:

a recovery tank for storing spent cleaning fluid and dirt that is recovered from the floor surface;

a suction source configured to generate a working airflow; and an extraction nozzle extending towards a surface to be cleaned and in fluid communication with the recovery tank;

a secondary housing removably mounted to the base assembly, the secondary housing including the extraction nozzle, a top wall, an opposing bottom wall confronting at least a portion of the first housing and a second retainer extending between the top wall and the opposing bottom wall; and at least one lock assembly provided for selectively coupling the secondary housing to the base assembly, the at least one lock assembly having a body configured to extend through the top wall at the second retainer to be selectively received within the first retainer and the second retainer.

* * * * *